US005958205A

United States Patent [19]

Ingalls et al.

[11] Patent Number: 5,958,205

[45] Date of Patent: Sep. 28, 1999

[54] APPARATUS FOR A FLUID FILTRATION SYSTEM

[75] Inventors: Rex Ingalls, Virginia Beach; John Kantak, Alexandria; Mel Chaskin, Clifton, all of Va.

[73] Assignee: Vipur, Fairfax, Va.

[21] Appl. No.: 08/861,111

[22] Filed: May 21, 1997

[51] Int. Cl.[6] ..... B03C 5/02

[52] U.S. Cl. ..... 204/664; 204/672

[58] Field of Search ..... 204/661, 662, 204/663, 664, 672, 673, 555, 556, 557, 572; 210/223, 243, 695, 748

[56] References Cited

U.S. PATENT DOCUMENTS

| | | | |
|---|---|---|---|
| 1,949,660 | 3/1934 | Roberts | 204/24 |
| 3,349,143 | 10/1967 | de Lano, Jr. | 585/323 |
| 4,238,326 | 12/1980 | Wolf | 210/695 |
| 4,254,393 | 3/1981 | Robinson | 335/209 |
| 4,594,138 | 6/1986 | Thompson | 204/665 |
| 4,604,203 | 8/1986 | Kyle | 210/489 |
| 4,941,959 | 7/1990 | Scott | 204/557 |
| 4,961,845 | 10/1990 | Dawson et al. | 210/85 |
| 5,149,422 | 9/1992 | Barrington | 210/85 |
| 5,242,587 | 9/1993 | Barrington et al. | 210/223 |

*Primary Examiner*—Kathryn Gorgos
*Assistant Examiner*—William T. Leader
*Attorney, Agent, or Firm*—Hazel & Thomas

[57] ABSTRACT

An electrostatic fluid filtration system of the present invention is designed to remove contaminants from liquids thereby refreshing their functionality and extending their useful life. This system reduces to commercial practice a myriad of partially attained and less efficient techniques of filtration by focusing upon economic, environmental, and health factors as well as simplicity of manufacture, use and maintenance. Several generic embodiments are identified for cooking oils, fuels, lubricants and solvents, all of which have been successfully demonstrated in commercial operating environments. Proven magnetic and electrostatic phenomenologies are integrated in a controlled system that is electronically and physically adaptable to the viscosity and dielectric properties of various fluids as well as contaminant characteristics.

79 Claims, 16 Drawing Sheets

10

10

14

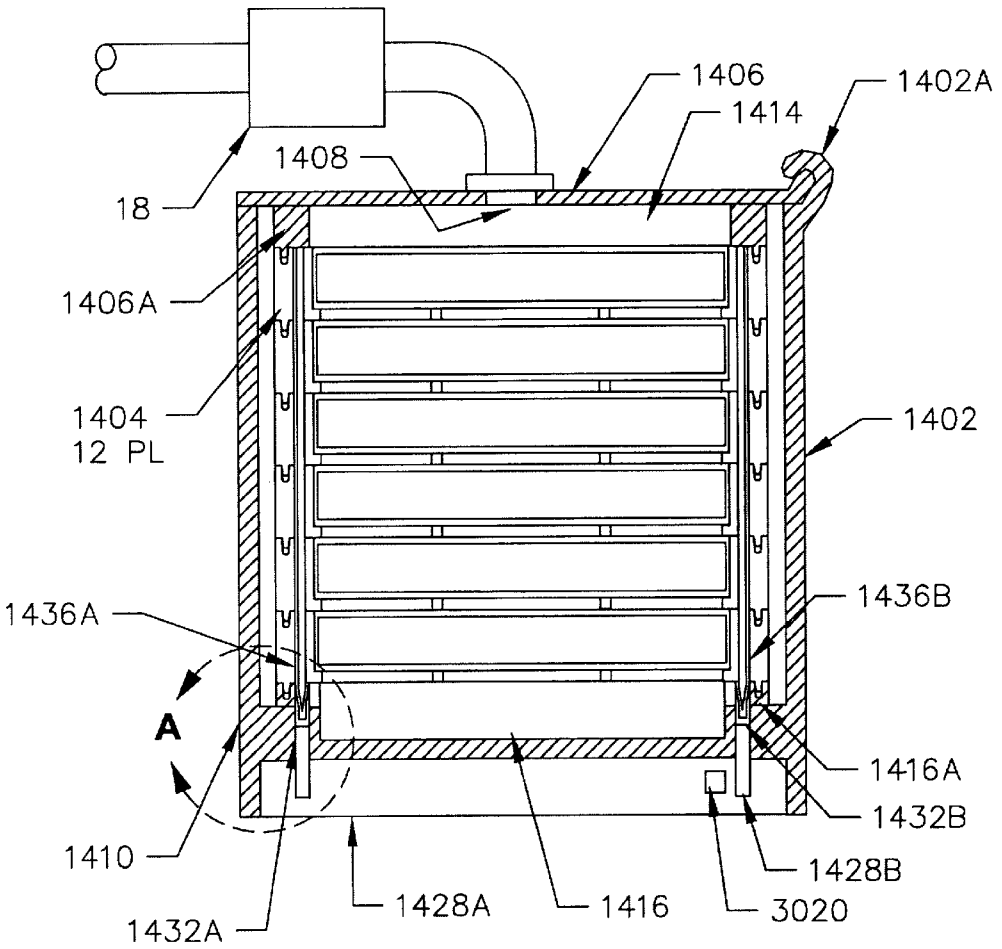
FIGURE 3B
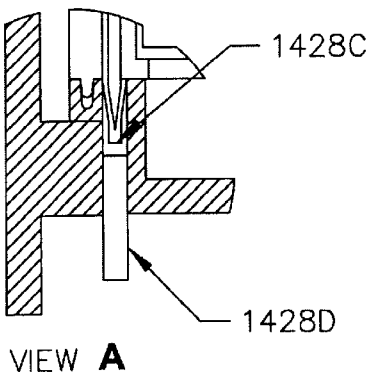

1404

10'

10'

32

34

34

10"

10"

10"

APPARATUS FOR A FLUID FILTRATION SYSTEM

BACKGROUND OF THIS INVENTION

1. Field of the Invention

This invention integrates electrostatic (fields) and magnetic (flux) phenomenologies, and mechanical (sieve) techniques, into a programmable and adaptable filtration system for the removal of contaminants from various hydrocarbon and organic fluids to refresh their functionality and extend their useful life in the commercial marketplace. This invention focuses upon a fluid filtration system design that is: economical to manufacture, use and maintain; easily adapted to different fluid properties and contaminant characteristics; safe and easy to use in the workplace; and provides both health and environmental advantages.

2. Discussion of the Prior Art

A plethora of concepts, methods and devices have been identified to remove particulate contaminants from hydrocarbon and organic fluids to extend their useful life, or increase the reliability of precision machinery, or improve the efficiency of combustion. Basic structures for removing finite particulates from fluids by mechanical, magnetic and electrostatic means are documented in the following prior art examples:

| | | |
|---|---|---|
| Barrington | 5,242,587 | 9/93 |
| Dawson | 4,961,845 | 10/90 |
| Scott | 4,941,959 | 6/90 |
| Eggerichs | 4,879,045 | 11/89 |
| Pera | 4,716,024 | 12/87 |
| Mintz | 4,634,510 | 1/87 |
| Nozawa | 4,620,917 | 11/86 |
| Kyle | 4,604,203 | 8/86 |
| Thompson | 4,594,138 | 6/86 |
| Collins | 4,303,504 | 12/81 |
| Stegelman | 4.285,805 | 8/81 |
| Robinson | 4,254,393 | 3/81 |
| Wolf | 4,238,326 | 12/80 |
| Watson | 4,190,524 | 2/80 |
| Noland | 4,025,432 | 5/79 |
| Davies | 3,655,530 | 4/72 |
| Van Vroonhoven | 3,484,367 | 12/69 |
| Lochmann | 3,398,082 | 8/68 |
| Waterman | 3,393,143 | 7/68 |
| Miyata | 3,349,143 | 10/67 |
| Griswold | 3,252,885 | 5/66 |

It is evident from the prior art that the use of mechanical, magnetic and/or electrostatic filtering can effect the performance and useful life of various hydrocarbon and organic based fluids. However, efficient and cost effective mobile filtration systems are not readily evident in the commercial marketplace.

The effectiveness of mechanical fluid filters, such as sieves (e.g., paper, cloth and meshes) is limited by the size of the passageway through the media. This limitation, even with current technology, restricts their capture effectiveness to particulates with diameters larger than about 5 microns, nominally less than 30% of the contaminant population. As an example, U.S. Pat. No. 4,604,203 to Kyle evidences this significant disadvantage, as well as a limited fluid throughput that is economically imprudent in the commercial marketplace.

To achieve the next filtration level, electrostatic filters are proposed. These filters impart an electrical charge to the contaminant particulates, including sizes much less than a micron, that causes these "fines" to attract one another to form "straws" that are sufficiently large to be captured on and in filtration media placed between alternately charged porous metal plates.

The electrostatic filter constructs disclosed in the references to Dawson (U.S. Pat. No. 4,961,845), Lochmann (U.S. Pat. No. 3,398,082) and Van Vroonhoven (U.S. Pat. No. 3,484,367) fail to employ magnetic fields and suffer reduced particulate removal efficiency (15–18%). Additionally, the construct shown in Dawson does not provide space for the accumulation of particulates which significantly reduces the lifetime (i.e., arcing) of the filter prior to disposal (vice reuse) and appears to be applicable only to the removal of large particulates.

The combination of electrostatic fields and magnetic flux is shown by the references to Miyata (U.S. Pat. No. 3,349,143), Robinson (U.S. Pat. No. 4,254,393) and Thompson (U.S. Pat. No. 4,594,138). Although the magnetic flux accelerates the charging of the particulates by the electrostatic fields, it is not clear that the references to Miyata or Robinson have demonstrated any filtering capabilities. All three suggest throw-away (versus reuse) filters, but only the Thompson reference suggests a limited system construct. Thompson's construct requires that the filter become a part of a hydraulic or dielectric fluid system, provides no obvious way to regulate voltage and current for changing fluid conditions, and provides no spacers for the accumulation of trapped particulates thereby shortening the economic life of the filter. The reference to Thompson also presents a fixed plate configuration suggesting that separate filters must be manufactured for different fluids.

The reference to Barrington (U.S. Pat. No. 5,242,587) comes closest to presenting a mobile stand-alone fluid filtration system. However, this design fails to address the safety, economics and usability requirements of the commercial marketplace. No discernable consideration is given to preventing access to the electrostatic voltage during use or maintenance, and the suggested plastics are not amenable to high temperature (e.g. , cooking oil) or corrosive solvents (e.g., tetrachlorathylene perclorethylene) thereby precluding use on the broad family of hydrocarbon and organic liquids. Additionally, the Barrington reference does not specify how voltage and current are tuned to either the fluid or the contaminant characteristics, which implies separate filter manufacturing for each fluid with the attendant increased costs resulting therefrom. Barrington also suggests that noncircular plate perforations (e.g., square, rectangular, triangular) are acceptable. However, it has been experimentally proven that corners and sharp edges expand to cause bypass under pressure and support the aggregation of captured particulate to produce arcing which shorts out the filters' efficiency and requires frequent cleaning. The second most significant economic drawback to this construct is the implementation of the electrical distribution in the electrostatic filter. Polyvinylchloride stand-offs are hand connected to create a vertical plurality of alternately charged plates, and must be totally disassembled for maintenance. This is a labor intensive cost driver for both manufacturing and maintenance. In addition, the use of PVC cut pipe is inadequate in that it will dissolve in some hydrocarbon fluid environments and deform at elevated temperatures.

Therefore, while many embodiments of electrostatic fluid filters are known, they are for the most part, commercially ineffectual, expensive to use and maintain, and not easily adapted to changing fluid requirements without considerable time and labor.

SUMMARY OF THE INVENTION

The overall objective of this invention is to provide an efficient and reliable fluid filtration system that is: (1)

economical to manufacture, use and maintain; (2) easily adapted to fluid properties and contaminant characteristics; (3) safe and easy to use in the workplace; (4) more efficient than previous conventional equipment; and (5) beneficial to both human health and the environment.

In this context, a specific object of this invention is to integrate mechanical filters with both magnetic and electrostatic phenomenologies to maximize the removal of submicron size contaminants (fines) from various fluids and thereby realize multiple, and in some cases indefinite, fluid reuse.

It is an object of this invention to provide a compact stand-alone mobile filter system configuration with both a structure and components that are relatively inexpensive. It is also an object to provide a simple and efficient method for interfacing this filter system with the target fluid and any associated equipment.

It is an object of this filter system to provide a programmable controller system, such as a Programmable Logic Controller (PLC), to automate sensor and filter operations, and ensure operator and component safety. It is also an object to provide a simple control panel that works with the controller system or PLC to allow reliable and positive operator control of the filtration system operation and to maintain the contaminant removal efficiency of the electrostatic filter.

It is an object of this invention to provide a plumbing infrastructure that can transport high temperature and corrosive fluids, satisfy UL and NSF organic fluid requirements, and satisfy EPA regulatory limits for drycleaning solvents.

An object of this invention is to provide a vacuum driven fluid transport infrastructure to ensure fluid-tight joints, eliminate pressure failures, and allow a simpler and more reliable pump design all in order to realize positive displacement of the fluid.

Another object of this invention is to provide extended use of a fluid filtration system without the need for extensive and expensive equipment tear-down and maintenance. To support this object, another object is to provide reusable mechanical and electrostatic filters that are easily accessible for maintenance.

It is an object of this invention to use a metal sieve at the filter input to remove large size (e.g., 0.18 inches) contaminants from the fluid to be cleaned. It is also an object to subsequently pass the fluid through a pre-filter device where a reusable felt filter removes particulates larger than 25 microns prior to the fluid being introduced to the magnetic and electrostatic phenomenologies.

It is an object of this invention to use an in-line kiloguass magnetic field to align all susceptible particulates and maintain a demonstrated increased particulate removal efficiency in excess of 15%.

It is an object of this invention to provide a controllable high voltage power supply that allows voltage and current to be adjusted to accommodate the dielectric and viscosity properties of various fluids. Another object is to have this power supply work with the PLC to allow easy adaptation to fluctuating fluid requirements, and provide for personnel safety.

Still another object of this invention is to provide modular electrostatic filter trays in a rectangular geometry that maximize the fluid-filter interface, and augment the electronic adaptability of the power supply by allowing physical separation changes between the charged and grounded plates to accommodate fluid dielectric and viscosity characteristics, and support easy maintenance and reuse.

Another object of the modular electrostatic filter trays is to apply power to and ground alternate porous conductive plates. Another object is to use smooth circular perforations which are self cleaning in the charged plates that offer no sharp edges for particulate aggregation and subsequent arcing, and support uniform electrostatic field distribution to maximize the charge given to contaminants.

An object of the modular electrostatic tray design is to provide space for the accumulation of captured particulate to extend the time between filter cleanings and to provide a physical support structure for both the porous plate and the interplate filter media.

Another object of this invention is to provide economic advantage to the operator through the extended reuse of the fluid and environmental benefits derived from significantly reduced fluid disposal actions (e.g., landfill, hazardous material landfill) and costs.

Another object of this invention is to provide health benefits through the reduction of fatty acids and peroxides in organic cooking fluids.

BRIEF DESCRIPTION OF THE DRAWINGS

The invention will be further described in conjunction with the accompanying drawings, in which:

FIG. 3B illustrates a detailed cross-sectional side view of the electrostatic filter device and the components therein taken along line 3B—3B from FIG. 3A in accordance with the general embodiment of the present invention;

DETAILED DESCRIPTION OF THE PREFERRED EMBODIMENTS

Figure 1:
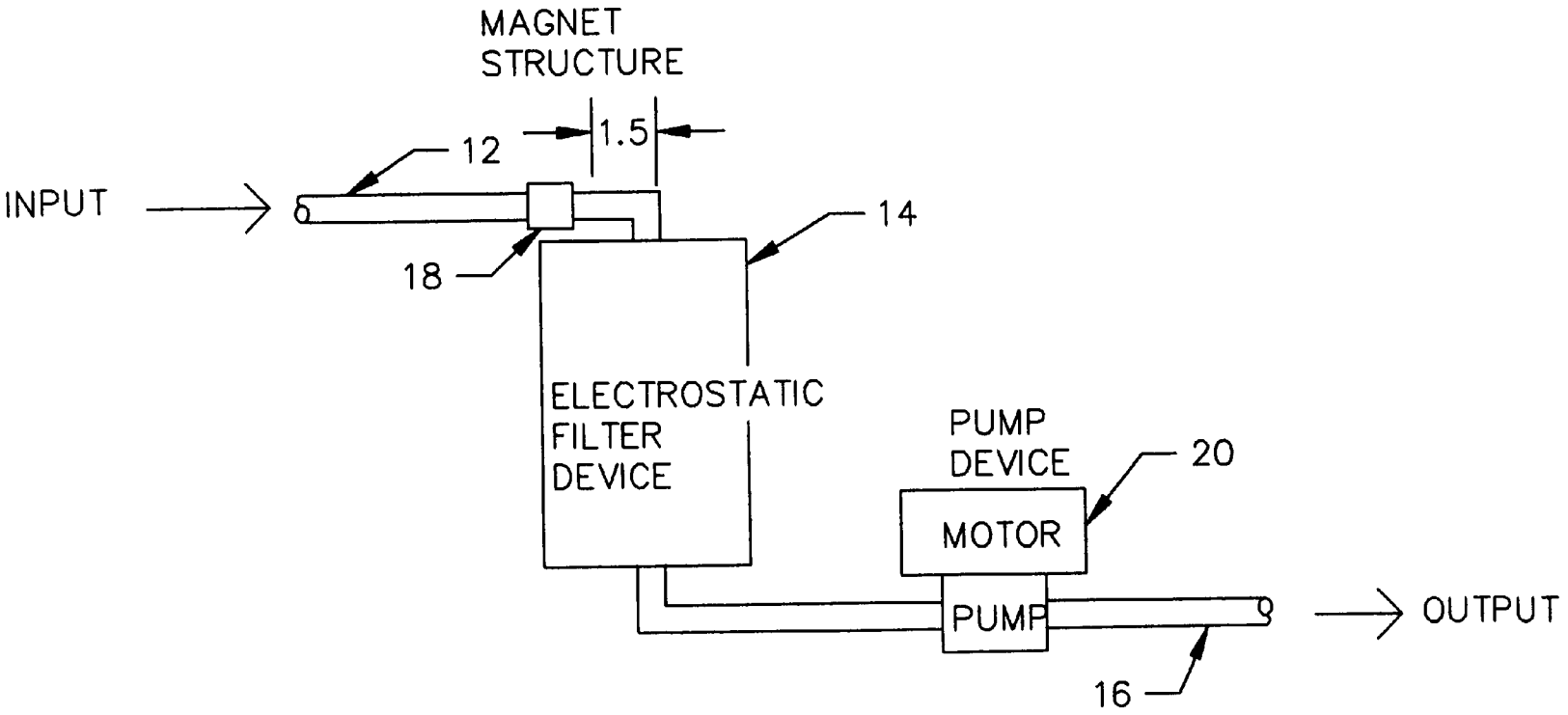
FIG. 1 is a general system diagram of the main components of a general embodiment of the present invention.

With reference to the figures, like reference characters will be used to indicate like elements throughout the several embodiments and views thereof. In particular, with reference to FIG. 1, the present invention is directed to a fluid filtration system 10 that is primarily composed of an input conduit 12 connected to an input end of an electrostatic filter device 14 and an output conduit 16 connected at an output end of the electrostatic filter device 14.

Figure 2A:
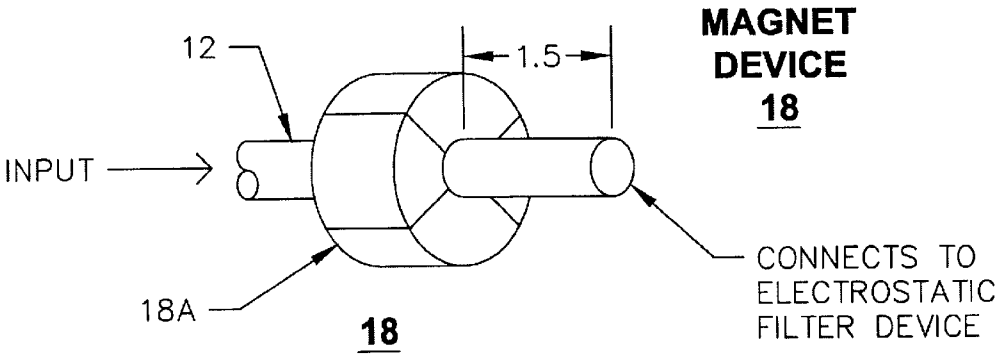
FIG. 2A illustrates a general arrangement for the magnets surrounding the input line in accordance with the general embodiment of the present invention.

The input conduit also incorporates a magnet structure 18 that surrounds the input conduit 12 at or very near the connection point between the input conduit 12 and the electrostatic filter device 14. As shown in FIG. 2A, the magnet structure 18 may be composed of a plurality of magnets or a single cylindrical magnet 18a fixedly mounted via, for example, permanent adhesive on the outer surface of the input conduit 12. The input conduit 12 itself is formed from a non-conductive, non-magnetic material, such as nylon 6/6, polyurethane or polyethylene, whereby the magnetic field generated by the magnet structure 18 may pass through to the fluid flowing through the input conduit 12. This allows the magnetic structure 18 to magnetize the fluid contaminants as they pass just prior to entering the electrostatic filter device 14. To effectively magnetize the fluid contaminants, the magnet structure 18 should be selected with a magnetic flux density within the range of 20,000 to 25,000 Gauss depending on the type and composition of the fluid. Examples of magnets that may be used for the magnet structure 18 include those made from rare earth metals encapsulated in plastic and bound in steel for focusing the magnetic flux toward the fluid passing by them.

In order to optimize the magnetization of the fluid contaminants, the magnet structure 18 is, as noted above, mounted to encircle the input conduit 12 at or very near the connection point between the input conduit 12 and the electrostatic filter device 14. In particular, the magnet structure 18 may be mounted on the input conduit a distance d from the point where the input conduit 12 connects to the electrostatic filter device 14, as illustrated in FIG. 2A. In at least one embodiment, the distance d is set within the range of 0.5 to 1.5 inches.

Along the output conduit 16 and downstream of the electrostatic filter device 14, a pump device 20 is used to vacuum draw the fluid being filtered through the system 10 (See FIG. 1). As with the input conduit 12, the material of the output conduit 16 is selected so as to be non-conductive and non-magnetic, such as nylon 6/6, polyurethane or polyethylene.

The arrangement of the pump device 20 so as to vacuum draw the fluid through the system 10 is used as a safety feature. Specifically, the vacuum drawing operation of the pump device 20 generates a negative pressure within the system. If any portion of the structural integrity of the system 10 through which the fluid flows were to be damaged or compromised, the negative pressure within the system 10 would force the system to implode into itself as a fail-safe measure. In a conventional arrangement, a pump would be positioned upstream of the filter device to force fluid into the filter device and thereby generate a positive pressure within the system. As one of skill in the art would appreciate, a positive and contained pressure within the system could cause an outward explosion if the structural integrity of the system were compromised. The structure of the pump device 20, as well as the present invention as a whole, is designed with all pressure bearing hoses and conduits vented to the ambient atmosphere, thereby precluding any explosive situations.

As an added level of safety, the pump device 20 is designed to autorotate if the plumbing infrastructure of the system becomes plugged, as will be explained further hereinbelow. In the autorotate mode, the pump device 20 precludes greater than single digit vacuum/pressure (i.e., pounds per square inch) in the system.

Figure 2B:
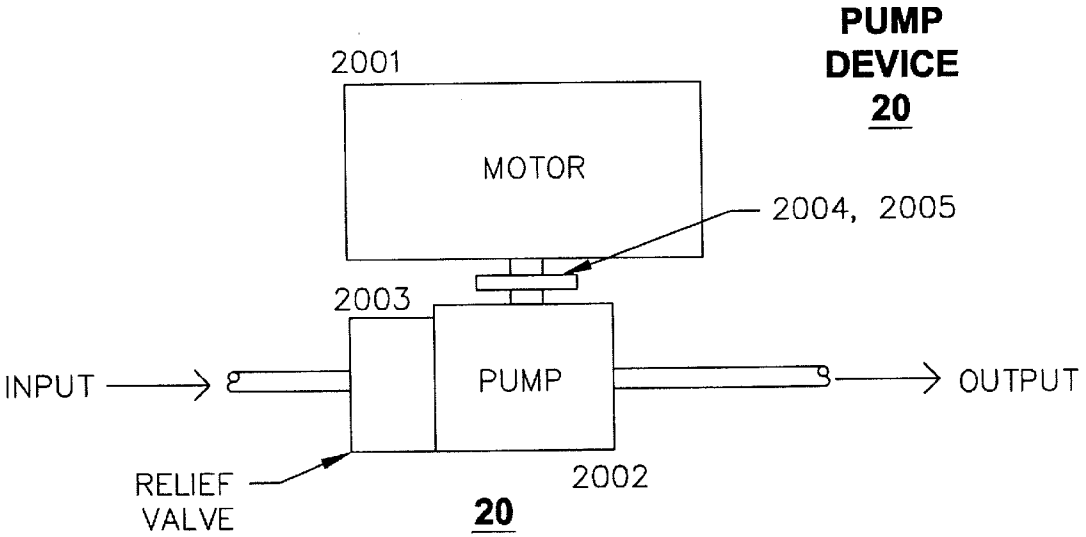
FIG. 2B illustrates a general block diagram showing the structure and operation of the pump device in accordance with the general embodiment of the present invention.

As illustrated in FIG. 2B , in a general embodiment, the pump device 20 incorporates a motor 2001 connected to a pump 2002 whose spur gears are designed to pull a vacuum in either direction with sufficient force to draw heavy fluids, such as cooking oil. To implement the autorotate mode, a pressure relief valve 2003 is connected to an input end of the pump 2002 and is designed to trigger at a predetermined level, for example 7 psi, that is indicative of the plumbing infrastructure being plugged or obstructed. Activation of the pressure relief valve 2003 cuts off the flow of fluid through the pump 2002, causing the pump to rotate without fluid going through until the filter flow sensor 3018 disables system operation. One example implementation of the pump device 20 would be the Hypro Corporation Model No. N-50. An example implementation of the relief valve 2003 is a Sherwood Model No. 17-4PH. Otherwise, the pump device and its components may be implemented using a conventional-type cast iron pump with steel mesh gears (e.g., 5.5 gpm capacity) and a motor (e.g., GE ⅓ HP type), as used in similar fluid moving applications, wherein the features of the pump device 20 as described above or hereinafter are incorporated using modifications and/or additional components that would be understood by one skilled in the art.

As an additional pressure mitigation feature, this embodiment of the pump device 20 further incorporates a brass shear key 2004 at the connection point 2005 between the motor 2001 and the pump 2002. If rotation of the pump 2002 is impaired, and the relief valve fails, the shear key 2004 will fracture disconnecting the motor 2001 from the pump 2002.

As one of skill in the art would appreciate, in addition to the requirement that the conduits be non-magnetic material, the sizes (i.e., inner/outer diameter, length) of the input conduit 12 and the output conduit 16 may be selected based on the type of fluid being processed, the amount per unit time selected for processing fluid and the environmental conditions in which the system would operate. For example, the material for the conduits may be selected to withstand temperature extremes and/or any corrosive or degrading effects of the fluid to be processed. Similarly, the type of pump device 20 and seals to be used may also be selected based on the type of fluid being processed, the amount per unit time selected for processing fluid and the system's environmental conditions.

Figure 3A:
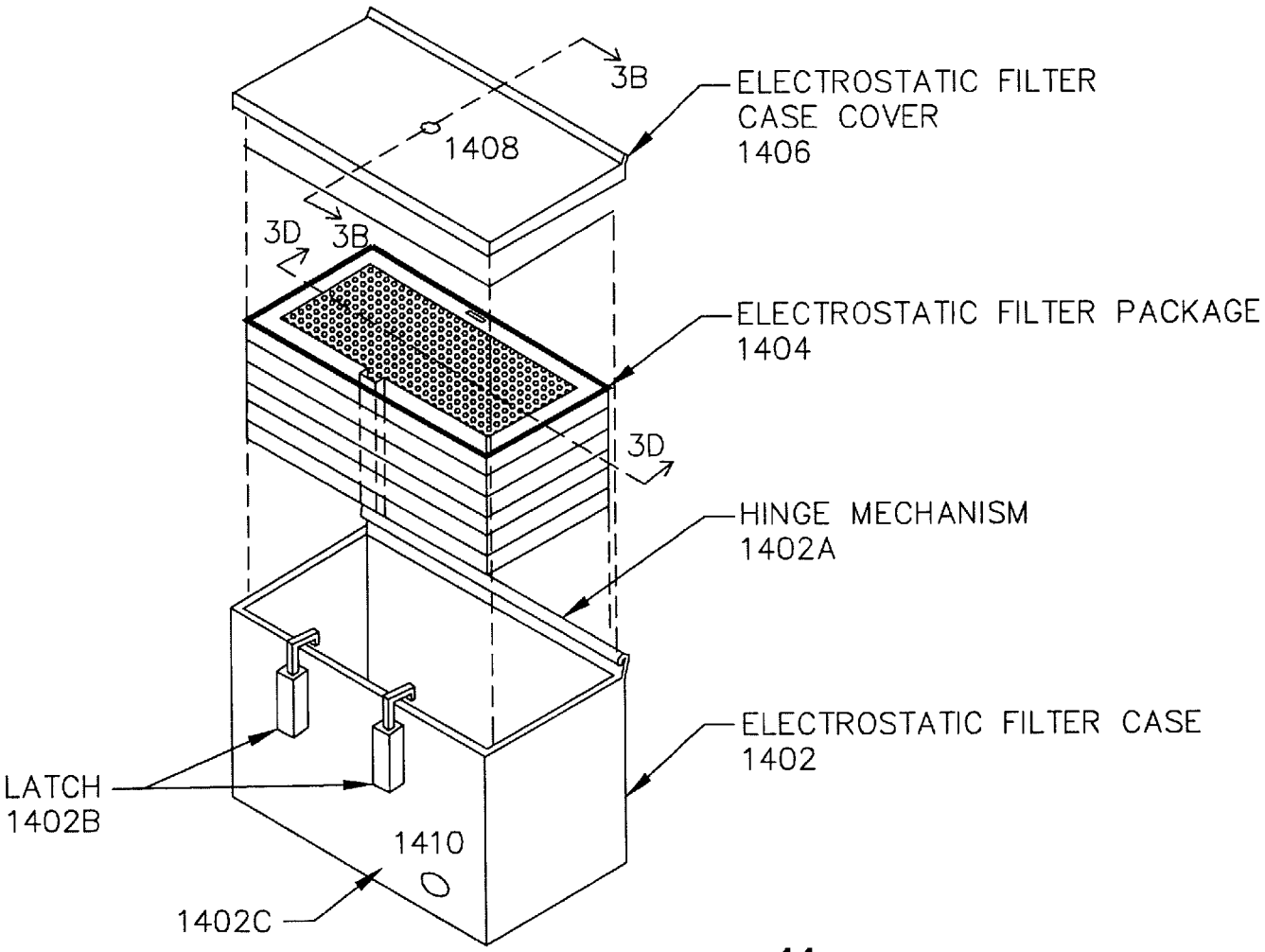
FIG. 3A illustrates a detailed exploded perspective view of the electrostatic filter device in accordance with the general embodiment of the present invention.

The electrostatic filter device 14, as shown in FIG. 3A, is composed of an electrostatic filter case 1402 in which a plurality of electrostatic filter packages 1404 are stacked together. An electrostatic filter case cover 1406 locks onto the opening of the electrostatic filter case 1402 thereby sealing the device together so as to be fluid-tight. The electrostatic filter case 1402 is formed with an input port

1408 and an output port 1410 at which the input conduit 12 and the output conduit 16, respectively, are fluid-tightly connected. In the specific embodiment of FIG. 3A, the electrostatic filter case 1402 is formed as a rectangular box with the input port 1408 defined on the top center of the electrostatic filter case cover 1406, and the output port 1410 defined on a lower end of the of the case sidewall 1402*c*. To fluid-tightly connect the electrostatic filter case cover 1406 to the electrostatic filter case 1402, in one embodiment, a hinge mechanism 1402*a* is mounted along one common side edge between the electrostatic filter case cover 1406 and the electrostatic filter case 1402 (See FIG. 3B). Latches 1402*b* are then used to lock down the opposite side edges of the electrostatic filter case cover 1406 and the electrostatic filter case 1402 together.

As shown in FIG. 3B, the electrostatic filter packages 1404 are stacked in the case 1402 wherein the input port 1408 is centered and located above the electrostatic filter packages 1404, while the output port 1410 is located below the packages. This configuration allows fluid to be vacuum drawn through the input conduit 12, through the input port 1408 and into the upper cavity 1414 of the electrostatic filter case 1402 above the electrostatic filter packages 1404 which are fixedly held in the main cavity 1402*d* of filter case 1402. The fluid then passes through the electrostatic filter packages 1404 down to a lower cavity 1416. As shown, the output port 1410 is defined to lead out of the lower cavity 1416 through the side of the case 1402 to the output conduit 16.

As will be explained further herein below, the underside 1406*a* of the electrostatic filter case cover 1406 emulates the lower half of an electrostatic filter package 1404, to include the bottom tray surface 1418*g* and the electrostatic package support frame 1420. That lower half of the electrostatic filter package forms part of the upper case cavity 1414 and is formed to replicate the shape and dimensions of the bottom tray surface 1418*g*, whereby the bottom tray surface will fluid-tightly fit with the upper tray surface 1418*a* of the topmost electrostatic filter package 1404.

Similarly, the electrostatic filter case 1402 incorporates in the base/lower cavity 1416 an upper portion 1416*a* that is formed to duplicate the shape and dimensions of a top filter tray surface 1418*a* of an electrostatic filter package 1404. This structure allows the upper portion 1416*a* of the base/lower cavity 1416 to achieve fluid-tight sealing contact with the bottom surface of the bottom-most filter package 1404 positioned on top of it.

As one skilled in the art will appreciate and understand, the dimensions, shape and materials of the electrostatic filter device 14 may vary depending upon the application and specific construction selected for the system. The design is scalable so that fluid cleaning can be matched with the operationally required throughput flow rate. In addition, the location of the input and output ports relative to each other and to the electrostatic filter packages 1404 may vary (e.g., defining the ports on two different sidewalls) so long as the general principle that the input port 1408 is located at the top of the electrostatic filter packages 1404, while the output port 1410 is located at the bottom, whereby the surface area of the filter packages through which the fluid to be processed generally flows is maximized.

As with the construction of the components of the system as discussed above, the construction of the electrostatic filter case 1402 and its cover 1406 may be selected based on the type of fluid being processed and the environmental conditions in which the system would operate. For example, both the electrostatic filter case 1402 and the cover 1406 may be formed to almost any size from polyurethane or nylon 6/6 by injection molding to ensure the proper tolerances and precise fitting needed to prevent fluid leakage. One of skill in the art will appreciate that there exist numerous conventional techniques applicable for constructing the various components in addition to those discussed herein, and that these conventional techniques known in the art include those for achieving the various detailed aspects of constructing the electrostatic filter device 14 including the fluid-tight sealing of the electrostatic filter case cover 1406 onto the electrostatic filter case 1402, the mounting of the electrostatic filter packages 1404 within the case 1402, the formation of the upper and lower cavities of the case 1402, the connecting of the input and output conduits to the input and output ports, respectively, and the mounting of the magnet device 18 onto the input conduit 12.

Figure 3C:
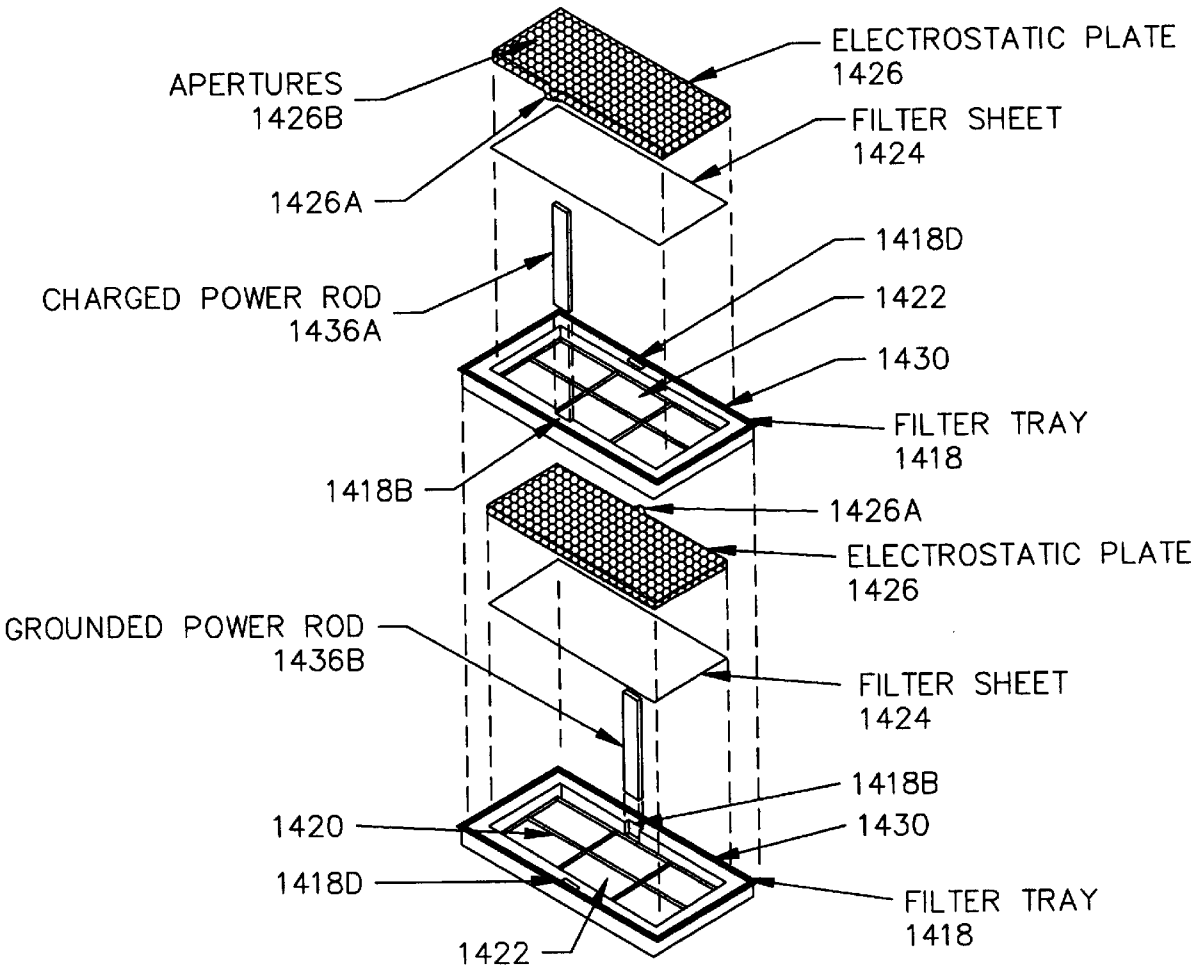
FIG. 3C illustrates a detailed exploded perspective view of the structure of an electrostatic filter package as used in the electrostatic filter device of the present invention shown in FIG. 3A.
Figure 3D:
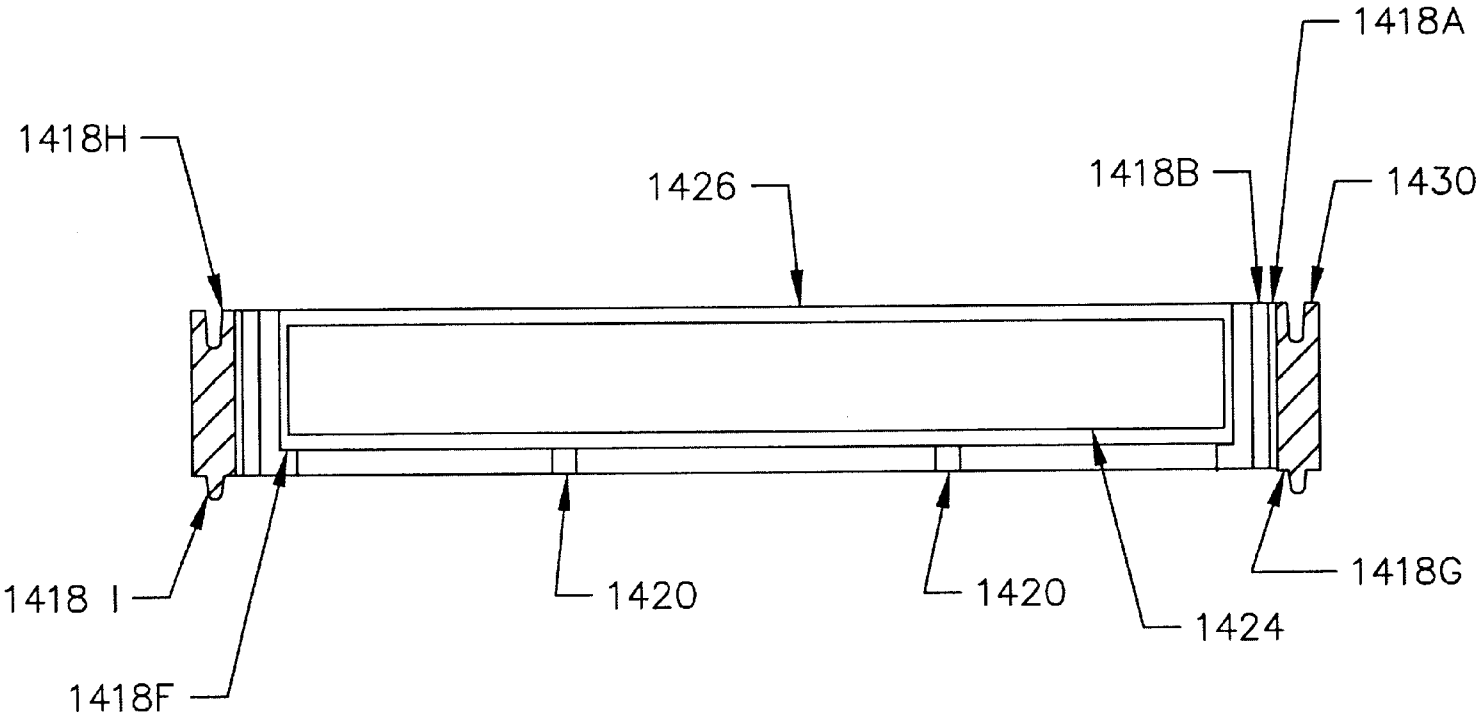
FIG. 3D illustrates a detailed cross-sectional side view of the structure of an electrostatic filter package taken along line 3D—3D from FIG. 3A as used in the electrostatic filter device of the present invention.

With respect to the electrostatic filter packages 1404, FIG. 3C shows that each filter package is composed of a filter tray 1418 with a support frame 1420 mounted in a cavity 1422 of the filter tray 1418. The cavity 1422 with the support frame 1420 together define a space within the filter tray 1418 in which a filter sheet 1424 is formed to fit on top of the support frame 1420. An electrostatic plate 1426 is then positioned on top of the filter sheet 1424 in the defined space such that the outer edges of the filter sheet 1424 are fixedly held between the outer edges of the electrostatic conductive plate 1426 and corresponding inside ridge of the electrostatic tray 1418. FIG. 3D shows a cross-sectional view of the electrostatic filter package 1404 to better illustrate the positioning of the various elements discussed above. The space between the porous electrostatic plate 1426 and the filter sheet 1424 accommodates the accumulation of trapped particulate thereby delaying arcing and extending the time between filter maintenance activities.

In at least one embodiment, the filter tray 1418 shown in FIG. 3C is formed from injection molded nylon 6/6 with the support frame 1420 also composed of nylon 6/6 to provide a non-conductive high-temperature tolerant structure. On the top surface 1418*a* of the filter tray 1418, a seal 1430 is embedded along an outer peripheral edge of that top surface. The seal 1430 provides a fluid-tight sealing contact between filter trays that are stacked one on top of the other. The seal 1430, as used in each filter tray 1418 and in the upper and lower filter package support portions, may be formed using rubber or vinyl, such as that used for O-ring seals, or other similar fluid sealing materials. The plurality of filter trays 1418 can be easily removed for cleaning and reuse.

The filter sheet 1424 is composed of a mechanical mesh-type filter, such as a polyolefin with a permeability selected based on the type of fluid being processed and the types of contaminants to be filtered out. For example, among the various embodiments, the permeability of the filter sheet 1424 may range between 25 and 100 pores per square inch. The material must also be selected so as to be non-reactive with the fluid to be processed. The filter sheets 1424 can be easily cleaned for reuse or simply replaced for ease of maintenance.

The electrostatic plate 1426 is composed of aluminum with a plurality of apertures 1426*b* defined throughout its surface. In at least one embodiment, the apertures 1426*b* are selected to be round, making them self cleaning, with 0.18 inch diameters and spaced 0.375 inches apart. This arrangement optimizes fluid throughput and contaminant charging. The entire outer periphery of the electrostatic plate 1426 is bent downward to form a cake tin-like shape that includes a power transfer tab 1426*a* that is positioned along one side edge of the electrostatic plate 1426. When positioned with the filter sheet 1424, the filter sheet 1424 is held in place between the downward edges of the electrostatic plate 1426 and a support ridge 1418*f* molded along an inner peripheral surface of the filter tray 1418.

Each filter tray 1418 includes two vertically-extending apertures, 1418*b* and 1418*d*, each defined at the center of two opposing side beams 1418*c* and 1418*e*. Aperture 1418*b* is defined to accept the electrostatic plate 1426 power transfer tab 1426*a* when the plate is positioned on the tray support frame 1420. Aperture 1418*d* is defined to electrically isolate the electrostatic plate 1426. The electrical context is defined herein below.

In the electrostatic filter case 1402 shown in FIG. 3B, a connector element 1428 is fixedly mounted on the base wall of the case, wherein the connector element 1428 is electrically connected at one end to an adjustable high voltage DC power supply, as will be explained further hereinbelow. The opposing end of the connector element 1428 is fed through the exterior wall into the interior of the electrostatic filter case 1402. In at least one embodiment, the connector element 1428 is composed of a pair of threaded aluminum bolts affixed to the bottom of the case so as to be leak proof, where one bolt embodies a power terminal 1428*a* and the other bolt embodies a ground terminal 1428*b*.

The opposing end of the connector element 1428, via the power terminal 1428*a* and the ground terminal 1428*b*, is then electrically connected to a pair of coupling elements 1432*a*, 1432*b*, respectively, that extend out toward opposing side walls in the interior of the electrostatic filter case 1402 and align with the position of the power transfer and/or isolation apertures 1418*b*, 1418*d* of the electrostatic filter packages 1404 in the electrostatic filter case 1402.

To electrically connect the electrostatic filter packages 1404 with the coupling elements 1432*a*, 1432*b*, power rods 1436*a*, 1436*b* are positioned atop the coupling elements, and the electrostatic filter packages 1404 are positioned in the electrostatic filter case 1402 with the power rods 1436*a*, 1436*b* vertically extending through the power transfer apertures 1418*b* and the isolation apertures 1418*d* of the filter packages. When the electrostatic filter case cover 1406 is fixedly positioned on top of the electrostatic filter case 1402, the power rods 1436*a*, 1436*b* are fixedly held in place between the case cover 1406 and the corresponding coupling element 1432*a* or 1432*b*. The filter packages are each selectively, electrically connected to the power rod 1436*a* coupled to the coupling element 1432*a* or to the power rod 1436*b* coupled to the coupling element 1432*b* by placing the filter package 1404 in the filter case 1402 so as to align its power transfer aperture 1418*b* with the selected power rod. Specifically, if a filter package is selected to be powered, e.g., 14,000 Vdc, its power transfer aperture 1418*b* is placed in the filter case 1402 such that its power transfer aperture 1418*b* interconnects with the power rod 1436*a* and its isolation aperture 1418*d* isolates the plate 1426 from the power rod 1436*b*. In this first position, the power transfer tab 1426*a* electrically connects with the power rod 1436*a*.

If a filter package is selected to be grounded, its power transfer aperture 1418*b* is placed in the filter case 1402 such that its power transfer aperture 1418*b* interconnects with the power rod 1436*b* and its isolating aperture 1418*d* electrically disconnects the plate 1426 from the power rod 1436*a*. In this second position, the power transfer tab 1426*a* electrically connects with the power rod 1436*b*. In essence, the filter packages selected to be powered are positioned 180° opposite the filter packages selected to be grounded.

In this one embodiment, the coupling elements 1428*a*, 1428*b* are formed to electrically connect with the power rods 1436*a*, 1436*b* through pressure contact. This is implemented by forming each coupling element with an extended metal V-shaped trench element 1428*c* positioned with the open end of the "V" facing upward and atop electrodes 1428*d*. With the power rods 1436*a*, 1436*b* positioned in their respective coupling elements, the closing of the electrostatic filter case cover 1406 will push down on the power rods and elastically deform the V-shaped trench elements, thereby achieving the pressure contact between the power rods 1436*a*, 1436*b* and the coupling elements 1428*a*, 1428*b*, respectively.

When the electrostatic filter packages 1404 are positioned in the electrostatic filter case 1402, the packages are stacked one on top of the other, whereby a top-most filter package in the stack is in fluid-tight sealing contact with the lower filter package support portion on the cover 1406, the remaining filter packages in the stack are each in fluid-tight sealing contact with a filter package on top of them, and the bottom-most filter package in the stack is in fluid-tight sealing contact with the top filter tray surface 1418*a* portion of the case 1402 base, all via their corresponding seals 1430. This structure prevents the flow of a fluid to be processed through the filter packages from bypassing the filter packages between the outer peripheries of the filter packages and the inner wall surfaces of the main cavity 1402*c*. This bypass preventing structure and operation is augmented by the vacuum drawing action of the pump device 20 to keep the flow of fluid within the filter packages 1404.

In order to obtain the fluid-tight sealing contact between the filter packages 1404 and the interior components of the electrostatic filter case 1402, the electrostatic filter case 1402 is formed so as to accommodate a fixed number of filter packages when sealed with the electrostatic filter case cover 1406. As shown in FIGS. 3B and 3D, the top surface 1418*a* of each filter tray may be formed with a locking slot 1418*h* that extends the entire perimeter of the tray. Correspondingly, the bottom surface 1418*g* of each filter tray may be formed with a locking protrusion 1418*i* that also extends the entire perimeter of the frame. When the electrostatic filter packages 1404 are stacked one on top of the other, the locking protrusions 1418*i* of each filter package will inter-engage with the locking slot 1418*h* of an adjacent package. Alternatively, each top surface 1418*a* may incorporate a seal 1430 (See FIG. 3C) that is fixedly mounted, e.g., using an adhesive, along its outer peripheral edge. When the filter packages are stacked together in the electrostatic filter case 1402, the seal 1430 allows the top surface 1418*a* of each filter tray or the upper portion 1416*a* of the lower case cavity 1416 to achieve fluid-tight sealing contact with the bottom surface 1418*g* of an adjacent filter package 1404 or the underside 1406*a* of the electrostatic filter case cover 1406 positioned on top.

In at least one embodiment, the filter case is designed to fluid-tightly accommodate six (6) filter packages. As one will appreciate, maximum filtration capability would be obtained by having every one of the six filter packages 1404 in the filter case 1402 equipped with an electrostatic plate 1426 and a filter sheet 1424 for certain types of fluids. This invention can be electronically and/or physically adapted to the dielectric value of the fluid and the contaminant characteristics, and can be scaled to accommodate various fluids throughputs (e.g., gallons per minute). To accommodate low dielectric valued fluids, the voltage/current can be adjusted (e.g., 9,000–15,000 Vdc) to prevent arcing between the charged and grounded plates when fluid is present. Physical adaptation means include the use of tray spacers 1412 by: 1) removing the plate from selected trays 1418; or 2) removing both the plate 1426 and the filter sheet 1424 from selected trays. The spacers are placed between charged and grounded packages 1404 to establish the physical separation required to prevent arcing between the charged and grounded packages when fluid is present. One such variation of the invention would use seven packages 1404 with a single spacer 1412 between alternately charged and grounded packages, while a second instantiation for a different fluid or contaminant would have ten packages with two spacers between charged and grounded packages. The size of the filter case 1402 and entire system is changed to accommodate the scaling.

As noted earlier, the design of the filter cases is scalable such that fluid cleaning can be matched with the operationally required throughput flow rate. In one embodiment, the filter tray face may be designed with a 140 square inch fluid face for a 5.5 gallon per minute throughput. In at least one alternate embodiment, the filter tray face may have a 6 square foot fluid face for a 200 gallon per minute throughput. However, operational requirements greater than 66 gallons per minute can be accomplished with the present invention.

Figure 4:
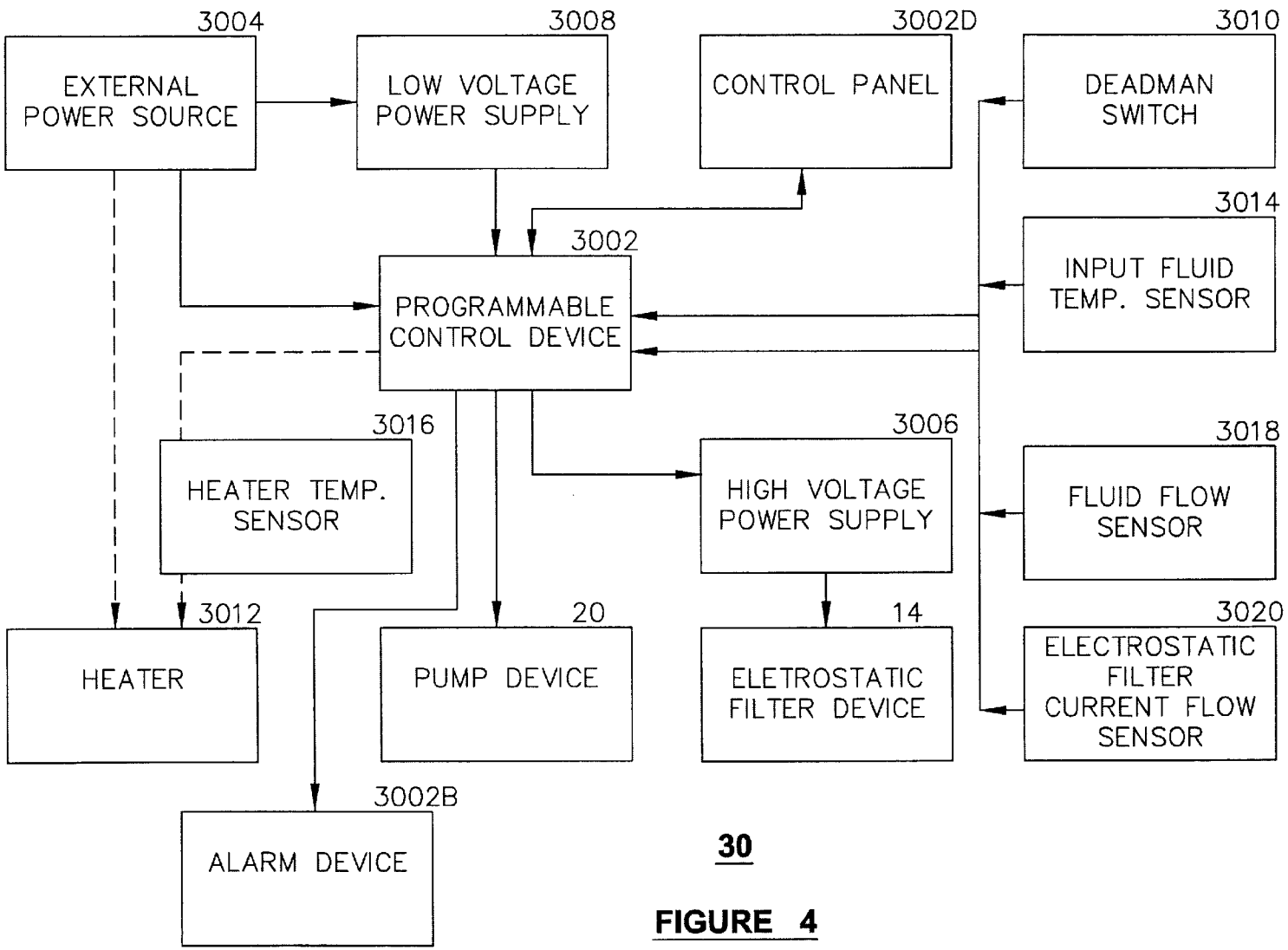
FIG. 4 is a general block system diagram of the control circuit for controlling the operation of the general embodiment of the present invention.

FIG. 4 is a general block system diagram of the control circuit 30 for controlling the first embodiment system of the present invention. As shown, the circuit 30 generally incorporates a programmable controller device 3002, an external power source 3004, a high voltage power supply circuit 3006, a low voltage power supply circuit 3008, and a plurality of safety devices including an input temperature sensor 3014 for monitoring the temperature of the fluid input to the system infrastructure and electrostatic filter packages 1404, a cabinet temperature sensor 3016 for monitoring the internal cabinet temperature of the electrostatic filter system 10', a fluid flow sensor 3018 for detecting the movement of fluid through the plumbing infrastructure of the system, an electrostatic filter current demand sensor 3020 for monitoring the buildup of contaminants in the electrostatic filter packages 1404, and a deadman switch 3010 connected to the electrostatic system cabinet cover 1001'.

The programmable controller device 3002 is operatively connected to control the operations of the high voltage power supply 3006, the pump device 20, as well as other application-specific devices 3012 and 3002*b*, as will be explained further hereinbelow. Specifically, the programmable controller device 3002 is operatively connected between the external power source 3004 and the high voltage power supply 3006 in order to control the directing of electrical power to the high voltage power supply. The programmable controller device 3002 is connected through the control panel 3002*a* to control the activation/deactivation of the pump device 20, i.e., through operation of the motor 2001. In addition, the programmable controller device is connected to receive input signals or commands from its operator input/output control panel 3002*a*, and to output warning signals and messages to the control panel 3002*a*. Even more, the programmable controller device is operatively connected to monitor the electrical or signal status of each of the sensors 3014–3020 and the deadman switch 3010, and to initiate the alarm device 3002*b* if the system 10' is left unconnected to the power source 3004 when not in use.

The low voltage power supply 3008 is operatively connected to receive electrical energy from the power source 3004, and thereby provide operating power for the programmable controller device 3002 and its associated circuit components, for example 5 Vdc, 3 A. The high voltage power supply 3006, as noted above, is operatively connected to receive power from the power source 3004 through the programmable controller device 3002 and as initiated via control panel 3002*a* by an operator. This is done so that the power output from the high voltage power supply 3006 can be cut off by the programmable controller device 3002 based on the status of the sensors 3014–3020 and the deadman switch 3010 and operator decision. The high voltage power supply 3006, in its normal operation powers the electrostatic filter device 1404 with, for example, 14 kVdc at 4 mA. In other embodiments the variable voltage/current of power supply 3006 could supply 10 KVdc at 2 ma or whatever voltage/current matches the fluid dielectric strength and contaminant characteristics. The capability to vary both the physical spacing of the filter package 1404 charged/grounded plates and the electrical power to generate electrostatic cleaning makes this filter device the most versatile electrostatic filter designed to date. The power source 3004 supplies conventional power, i.e., 110 Vdc 60 Hz, to the control system 30. As one skilled in the art will understand, the voltage, current and frequency levels for each of the power supplies/source discussed above may vary depending on, among other factors, the particular application of the system and the type of power source available, e.g., 220 Vdc at 50 Hz.

With respect to the sensors, the input temperature sensor 3014 depicted in FIGS. 5A and 5C, positioned on the feed conduit 37 near its connection to the sieve and sump structure 32, monitors temperature of the fluid input to the system 10' and the electrostatic filter packages 1404 in order to limit that temperature to below the tolerable limits of the system components that are temperature sensitive. In one system embodiment, 10', cooking oil for example, if the maximum temperature of the oil entering the filter device exceeds 200° F. at the sensor 3014, the programmable controller 3002 will disable power delivery to the pump device 20 thereby precluding oil entry into the filter's infrastructure. The cabinet temperature sensor 3016, located in the electrostatic filter cabinet 10', shown in FIG. 5B, may be an integral part of heater device 3012 and is used to monitor the internal temperature of the system infrastructure and the electrostatic filter device 14 when the system is stored between uses. For example, the internal temperature may be maintained at 110° F. by the heater device 3012, as an example, in order to prevent coagulation and hardening of any residual fluids in the system that were not recovered, e.g., cooking oil. The fluid flow sensor 3018, positioned on the output conduit 16, detects the movement of fluid through the plumbing infrastructure of the system in order to selectively shut off the pump device 20 when fluid is not present or flowing. The electrostatic filter current sensor 3020 connected to connector elements 1428*a*, 1428*b* (See FIG. 3B) monitors the buildup of contaminants in the electrostatic filter packages 1404 by detecting an increasing level of current flow in the electrostatic filter device 14. When contaminant accumulation has built up to a degree in the electrostatic filter packages 1404 that requires cleaning or changing, the contaminants will cause shorting between the electrostatic plates 1426, at which point the current sensor 3020 will signal the operator via a control panel 3002*a* visual indicator. The deadman switch 3010 is connected to the electrostatic filter system cabinet cover 1001' for cutting off power to the high voltage power supply circuit 3006 whenever the cabinet cover 1001' is opened (e.g., 0.25 inches).

As examples for the implementation of the different sensors as discussed above, the temperature sensor 3014 may be implemented using a conventional bimetallic temperature sensor. The temperature sensor 3016 may be implemented using a conventional aluminum thermostat that limits the temperature to 110° F. The deadman switch 3010 may be implemented with a Micro DPDT NC switch. The flow sensor 3018 may use a conventional magnetic reed switch.

In the general operation of the control circuit 30, an initial activation or START command via the control panel 3002*a* from an operator initializes the control system 30. The control system 30 begins by energizing the high voltage power supply 3006 while a time delay counts down a predetermined time period before energizing the pump device 20. This time delay is used to ensure that the high voltage power supply 3006 fully energizes the selected electrostatic plates 1426 in the electrostatic filter device 14 before fluid drawn into the system enters the electrostatic filter device 14. After fluid begins to flow through the filter device, the control system 30 maintains a monitoring mode, wherein the programmable controller device 3002, among other functions: (1) monitors the lockout condition of the electrostatic filter cabinet cover 1001' via the deadman switch 3010; (2) monitors the temperature of the fluid coming into the filter system 10' via the input temperature sensor 3014; (3) monitors the current drawn by the electrostatic filter device 14 via the current sensor 3020; and (4) monitors the flow of fluid through the plumbing infrastructure of the system via the filter fluid flow sensor 3018.

If the programmable controller device 3002 detects that the normally closed deadman switch 3010 has been opened indicating that the electrostatic filter cabinet cover 1001' is open, the power source 3004 is shut off. If the level of power being delivered to the electrostatic filter device 14 is too high as indicated by too high a current draw, the programmable controller device will initiate a warning light on control panel 3002*a* and at a predefined limit disengage power from the high voltage power supply 3006. If the programmable controller device 3002 detects that the input fluid temperature is too high, or that fluid flow through the plumbing infrastructure is too low indicating a blockage or cleaning is complete, the programmable controller device will shut down the pump device 20. In each case, the programmable controller device 3002 may then generate a warning or alarm signal to the operator via the control panel 3002*a* and alarm device 3002*b*. Examples of warning signals known in the art include visual types such as warning lights, and audible types such as bells or buzzers.

Figure 5A:
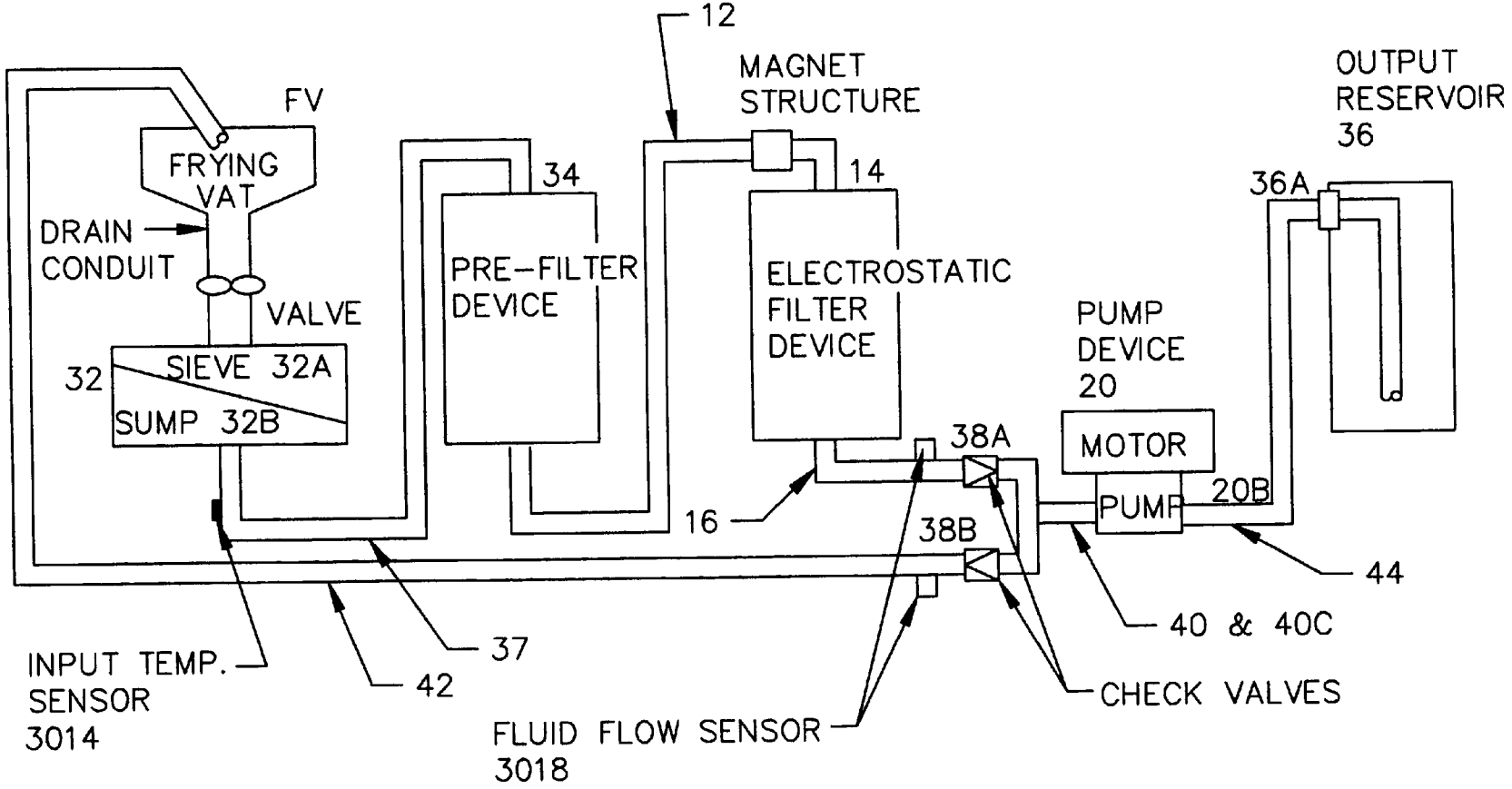
FIG. 5A is a general system diagram of a first preferred embodiment of the present invention.
Figure 5B:
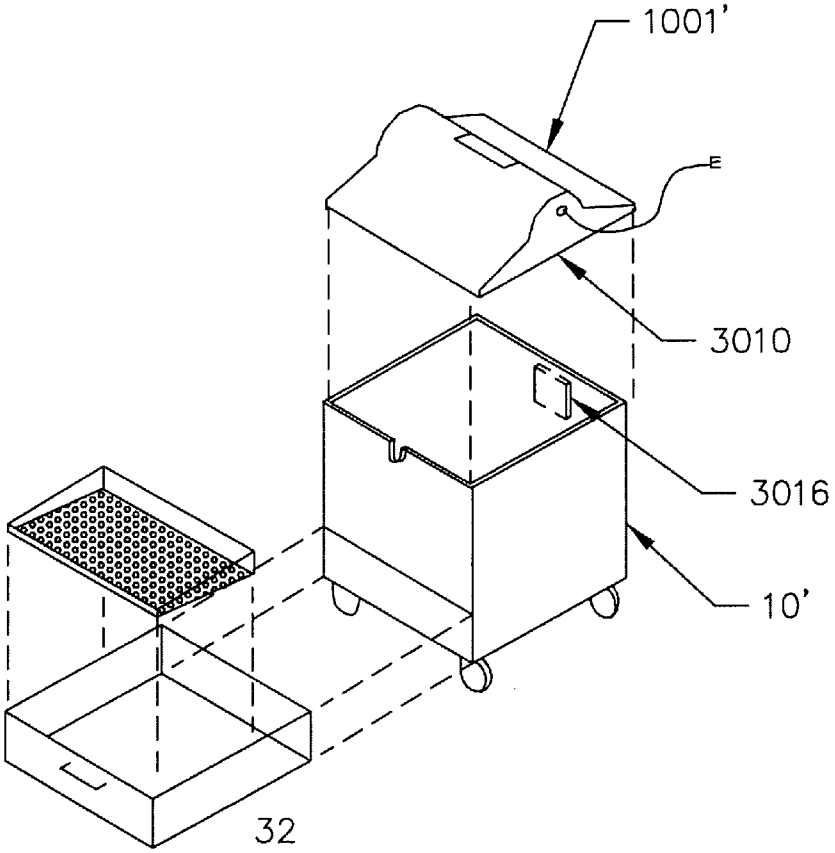
FIG. 5B is a system cabinet view of the first preferred embodiment.
Figure 5C:
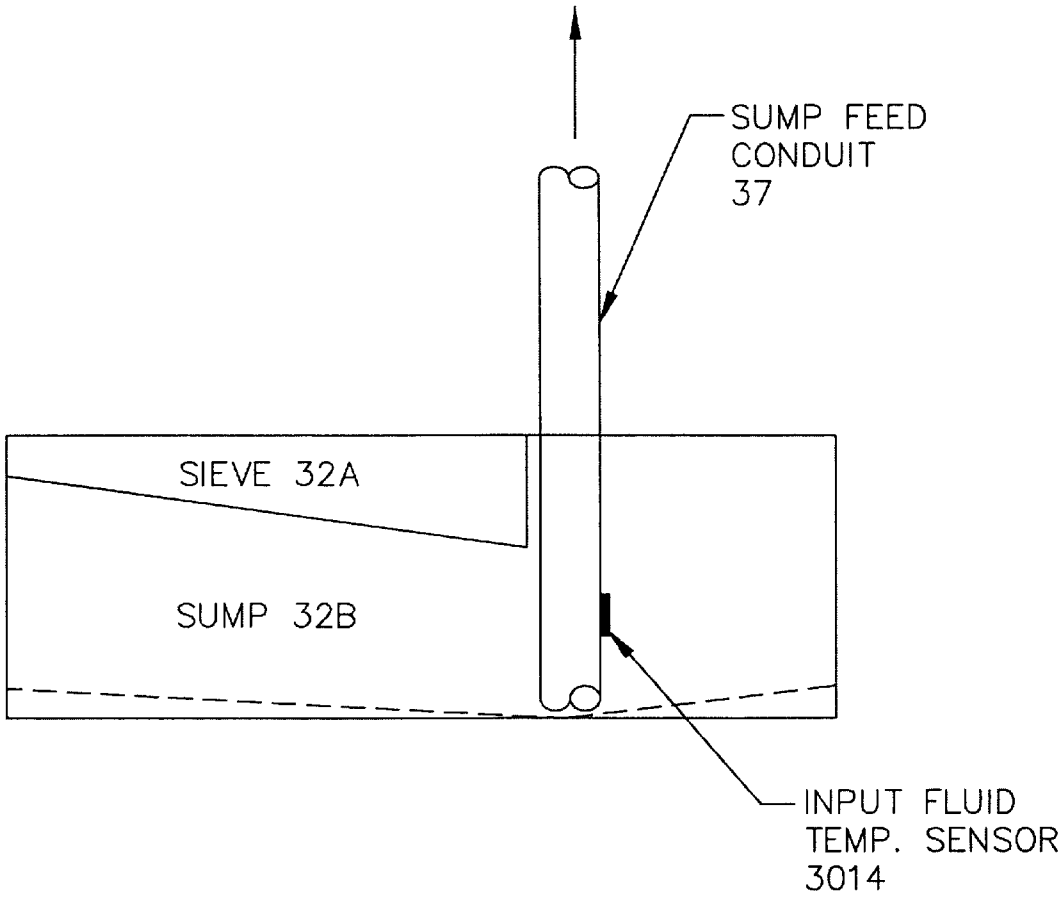
FIG. 5C is an expanded view of a first preferred embodiment input mechanism showing physical relationships.

In the general operation of the fluid filtration system 10' shown in FIG. 5A, fluid to be processed is introduced via the feed conduit 37. As noted above, the pump device 20 located downstream of the electrostatic filter device 14 vacuum draws the fluid through the entire system infrastructure and filtration devices. As the fluid passes the magnet structure 18, the susceptible contaminants in the fluid are magnetized and oriented in the direction of the fluid flow, making them more susceptible to accepting an electrical charge. The fluid is drawn from the input conduit 12 through the input port 1408 and into the upper cavity 1414 of the electrostatic filter case 1402. The fluid is drawn through the electrostatic filter packages 1404 that are fluid-tightly stacked in the main cavity 1402*d*, where the contaminants are electrically charged and filtered out. As the fluid is filtered by the electrostatic filter packages 1404, the fluid is drawn through the lower cavity 1416 and out through the output port 1410, into the output conduit 16 and through the pump device 20. As noted above, the general operation of the system is monitored by the control system 30.

Within the stack of electrostatic filter packages 1404, FIG. 3B, a high voltage charge is generated between matching pairs of electrostatic plates 1426, one of which is charged, for example, with 14,000 Vdc from the high voltage power supply 3006, while the other is grounded. This high voltage charges the magnetized contaminant particles, causing them to aggregate and form larger particles or "straws" as the fluid passes through the electrostatic plates 1426. The filter sheet 1424 is then able to trap these relatively large straws filtering them out of the fluid. Straws and fines also aggregate on the surface of the charged electrostatic plates 1426 and in the space between the electrostatic plates 1426 and the filter sheets 1424 of each electrostatic filter package 1404.

First Embodiment

As illustrated in FIG. 5A, a first embodiment of the present invention is directed to the filtering and processing of fluids in a relatively high temperature environment. One such application for the present invention is the processing of cooking oil from frying vats used by restaurants and fast food chains. In this embodiment, the fluid filtration system 10' of the present invention incorporates the input conduit 12 connected to the input end of the electrostatic filter device 14, and an output conduit 16' connected at the output end of the electrostatic filter device 14, along with an initial sieve and sump structure 32, a pre-filter device 34 and an output reservoir 36.

A frying vat FV whose cooking oil is to be processed is connected via its drain conduit DC to the sieve and sump structure 32 which is then connected via a feed conduit 37 to the input of the pre-filter device 34. The output of the pre-filter device 34 is connected to the input conduit 12 into the electrostatic filter device 14. As with the general embodiment, the magnet structure 18 is fixedly mounted on the input conduit 12 at or very near the connection point between the input conduit 12 and the electrostatic filter device 14. The output port of the electrostatic filter device 14 is connected to the output conduit 16' which in this embodiment includes a pair of check valves 38*a*, 38*b* and a bifurcated joint member 40. The bifurcated joint member 40, such as a Y-shaped or T-shaped pipe joint, along with the check valves 38*a*, 38*b* is connected so as to control the flow of the cooking oil to and from the reversible pump device 20 and the output reservoir 36.

Specifically, the check valve 38*a* is connected between the output conduit 16' and an input port 40*a* of the bifurcated joint member 40. The check valve 38*b* is connected between an output port 40*b* of the bifurcated joint member 40 and a return flow conduit 42 that leads back to the frying vat FV. A bidirectional port 40*c* of the bifurcated joint member 40 is connected to first port 20*a* of the pump device 20. A bi-directional conduit 44 is connected between the second port 20*b* of the pump device 20 and a bi-directional port 36*a* of the output reservoir 36.

In this first embodiment, the pump device 20 is configured to selectively pump fluid in either direction, i.e., into or out of the output reservoir as commanded via the control panel 3002*a*, in conjunction with the operation of the check valves 38*a*, 38*b*. In particular, when the pump device 20 is pumping in a processing state, the check valve 38*a* is in an open state and the check valve 38*b* is in a closed state. Fluid is drawn from the sieve and sump structure 32 into the feed conduit 37 as shown in FIG. 5C, through the pre-filter device 34 and the magnet structure 18 and the electrostatic filter device 14, through the output conduit 16, the check valve 38*a* and the bifurcated joint member 40, the pump device 20, and through the bi-directional conduit 44 into the output reservoir 36. When the pump device 20 is pumping in a return state, the check valve 38*b* is in an open state and the check valve 38*a* is in a closed state. Fluid flow occurs from the output reservoir 36 through the bi-directional conduit 44, through the pump device 20, the bifurcated joint member 40 and check valve 38*b*, and through the return flow conduit 42 back to the frying vat FV, under command from the operator interface control panel 3002*a*.

For this first embodiment and application of the present invention, the feed conduit 37, input conduit 12, output conduit 16, return flow conduit 42 and bi-directional conduit 44 may be formed from non-conducting and insulated, black FDA approved edible oil hose in order to avoid any unwanted build-up of electrostatic charges outside of the electrostatic filter device 14 and/or stray magnetic fields. The check valves 38*a*, 38*b* may be implemented using relatively conventional configurations made from nylon 6/6 with 304 stainless steel balls and retaining bars. The bifurcated joint member 40 may also be implemented using non-conducting nylon 6/6. Alternatively, the check valves 38*a*, 38*b* and the bifurcated joint member 40 may be implemented using a single three-way check valve made from nylon 6/6 with 304 stainless steel balls.

Figure 6:
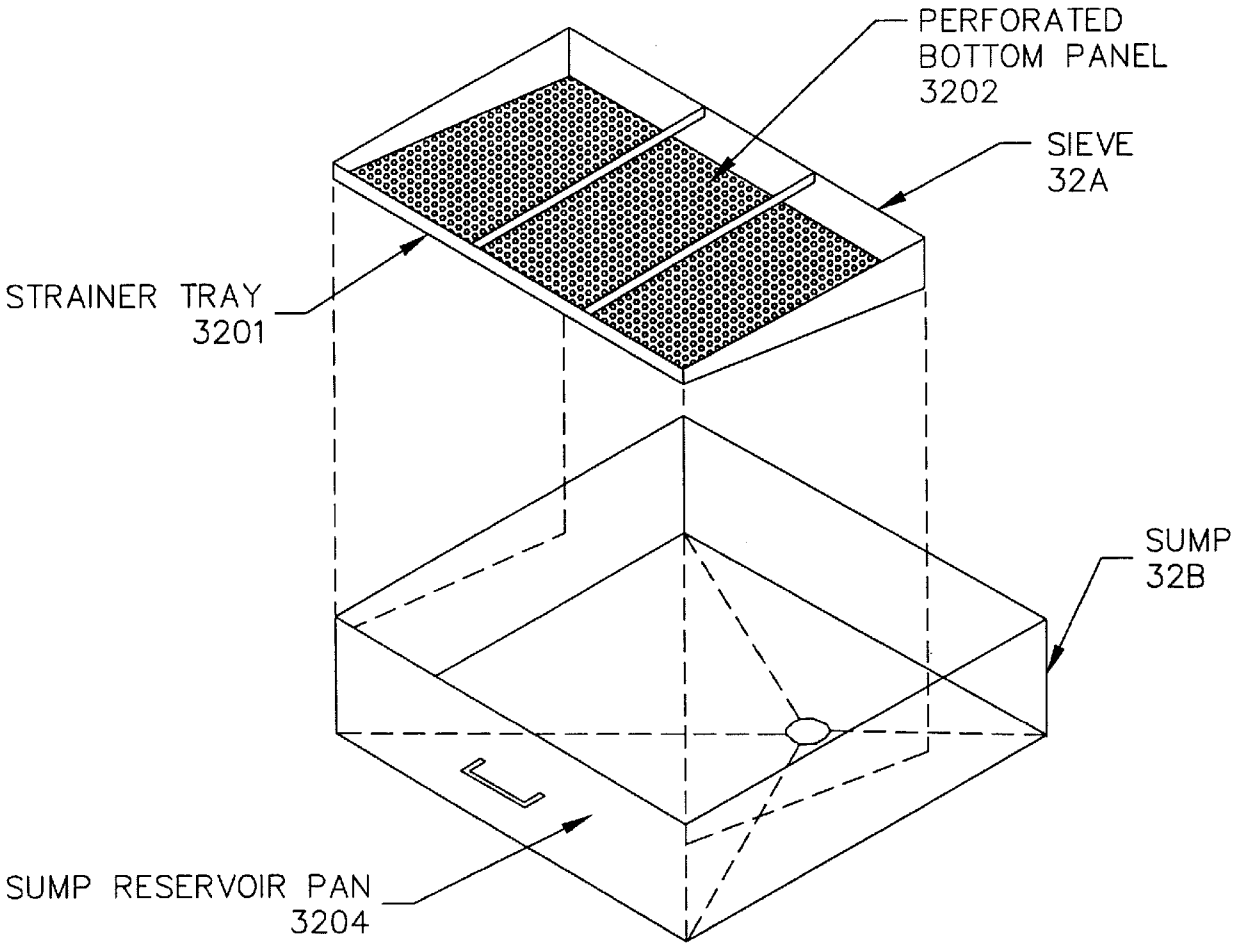
FIG. 6 illustrates a detailed exploded perspective view of the sieve and sump structure in accordance with the first embodiment of the present invention in accordance with FIG. 5.

FIG. 6 illustrates the individual sieve and sump components 32*a*, 32*b* of the sieve and sump structure 32 which is unique to this embodiment. In this embodiment, the sieve component 32*a* is formed as a strainer tray 3201 having a bottom panel 3202 fixedly positioned at a declining angle (for example, 13° ) to promote downward flow by gravity. The bottom panel 3202 is also perforated (for example, 0.0625" holes) to allow initial straining of the cooking oil to remove the larger debris particles (e.g., 200 microns or larger). The sump structure 32 extends from the cabinet 10' and provides the fluid input interface with the fryer drain.

The sump component 32*b* is embodied in a sump reservoir pan 3204 formed to accommodate the strainer tray 3201 on the top front portion, whereby cooking oil being strained by the strainer tray 3201 will automatically flow from the strainer tray 3201 into the sump reservoir pan 3204. The sump reservoir pan 3204 is formed with a bottom portion 3204*a* toward which the entire surface of the pan floor 3204*b* decline, forming a cone-like shape. By gravity, the cooking oil will flow and center around the bottom portion 3204*a*. In order to draw cooking oil from the sump reservoir pan 3204 for processing, the feed conduit 37 is formed such that an intake end of the feed conduit 37 is positioned at or near the bottom portion 3204*a* of the sump reservoir pan 3204. Again by gravity, the cooking oil will continue to flow towards the bottom portion 3204*a* as cooking oil is drawn out through the feed conduit 37. In this embodiment, the feed conduit 37 may also be constructed so that it may adjustably be fed into or withdrawn from the sump reservoir pan 3204. This is done so that, if an operator needed to remove the sump pan reservoir 3204 for cleaning, the intake end of the feed conduit 37 will not interfere with the removal of the pan, or be damaged when the pan is removed.

In at least one embodiment, the strainer tray 3201 and the reservoir pan 3204 are formed from 304 stainless steel. The strainer tray 3201 is mounted onto the reservoir pan 3204 using conventional mounting techniques known in the art such as supports made from stainless steel that are welded to the sides of the reservoir pan.

Figure 7A:
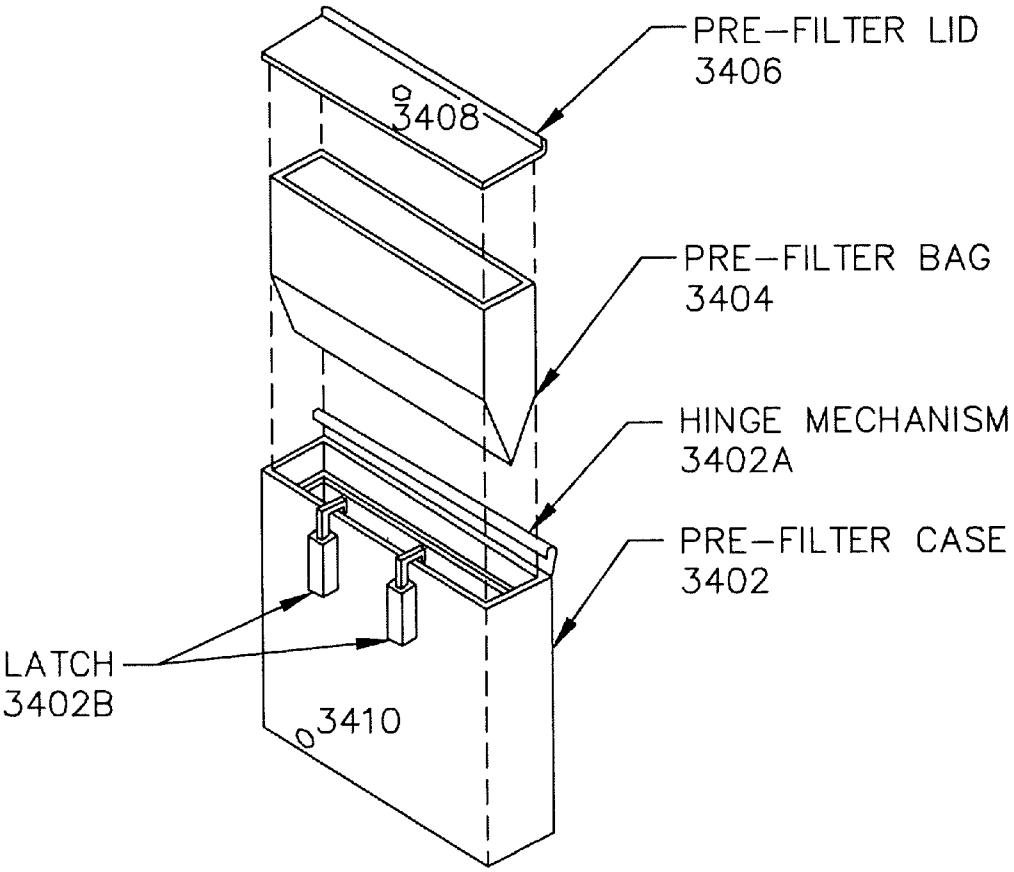
FIG. 7A illustrates a detailed exploded perspective view of the pre-filter structure in accordance with the first embodiment of FIG. 5, and potentially all embodiments.
Figure 7B:
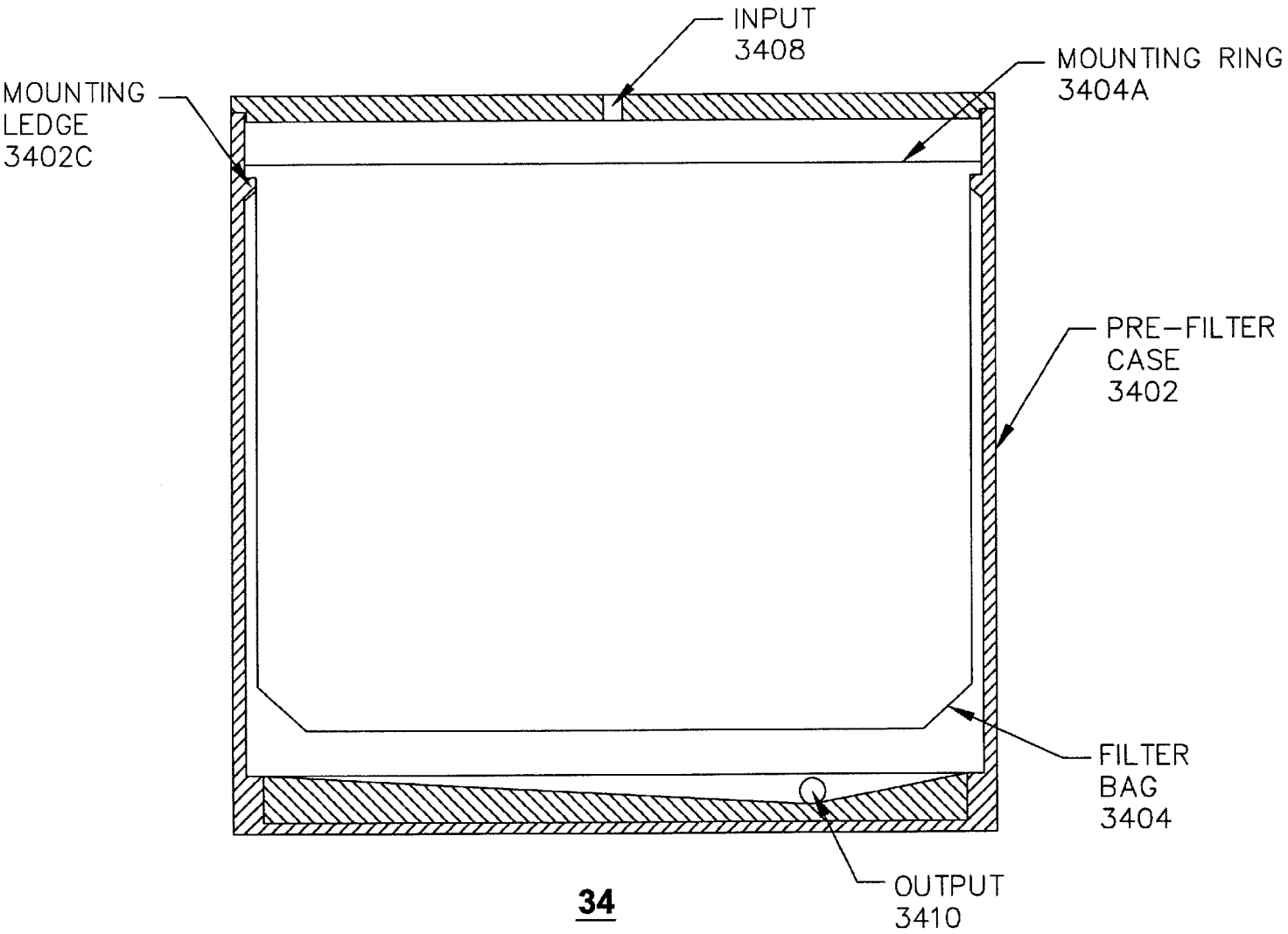
FIG. 7B illustrates a detailed cross-sectional view of the pre-filter structure in accordance with the first embodiment of FIG. 5, and potentially all embodiments.

FIGS. 7A and 7B illustrate the components of the pre-filter device 34, wherein the device incorporates a pre-filter case 3402 in which a pre-filter bag 3404 bag is positioned. A pre-filter case cover 3406 locks onto the opening of the pre-filter case 3402 thereby sealing the device together so as to be fluid-tight. The pre-filter case 3402 is formed with an input port 3408 and an output port 3410 at which the feed conduit 37 and the input conduit 12, respectively, are fluid-tightly connected. The pre-filter case 3402 is formed as a rectangular box with the input port 3408 defined in the center of the pre-filter case cover 3406, and the output port 3410 defined on a lower end of the sidewall 3412. The pre-filter bag 3404 is positioned in the case 3402 wherein the input port 3408 is located above the pre-filter bag 3404, while the output port 3410 is located below the bag. This configuration allows fluid to be vacuum drawn through the feed conduit 37, through the input port 3408 and into an upper cavity 3434 of the pre-filter case 3402 above the pre-filter bag 3404 which is fixedly held in the main cavity 3432. The fluid then passes through the pre-filter bag 3404 down to a lower cavity 3416.

In one embodiment for fluid-tightly connecting the pre-filter case cover 3406 to the pre-filter case 3402, a hinge mechanism 3402*a* is mounted along one common side edge between the pre-filter case cover 3406 and the pre-filter case 3402. Latches 3402*b* are then used to lock down the opposite side edges of the pre-filter case cover 3406 and the pre-filter case 3402 together. The upper edges of the pre-filter bag 3404 contain a mounting ring 3404*a* which fits atop a mounting ledge 3402*c* in the pre-filter case 3402 when the pre-filter bag is in position.

As one of skill in the art will appreciate and understand, the dimensions, shape and materials of the pre-filter device 34 may vary depending upon the application and specific construction selected for the system. In addition, the location of the input and output ports relative to each other and to the pre-filter bag 3404 may vary (e.g., defining the ports on two different sidewalls) so long as the general principle that the input port 3408 is located on an input side of the pre-filter bag 3404, while the output port 3410 is located on the other side, whereby the cooking oil to be processed flows into and through the pre-filter bag 3404. In at least one implementation, the pre-filter bag 3404 is formed from a polyolefin with its mounting ring formed from carbon or stainless steel.

As with the construction of the components of the system as discussed above, the construction of the pre-filter case 3402 and its cover 3406 may be selected based on the type of fluid being processed, the amount per unit time selected for processing fluid and the environmental conditions in which the system would operate. For example, both the pre-filter case 3402 and the cover 3406 may be formed from polyurethane by rotational molding. The pre-filter bag 3404 may be formed using, for example, 50 micron cloth or paper filter material, the hole size being dictated by the fluid flow rate desired. One of skill in the art will appreciate that there exist numerous conventional techniques applicable for constructing the various components in addition to those discussed herein, and that these conventional techniques known in the art include those for achieving the various detailed aspects of constructing the pre-filter device 34 including the fluid-tight sealing of the pre-filter case cover 3406 onto the pre-filter case 3402, the mounting of the pre-filter bag 3404 within the case 3402, the formation of the upper and lower cavities of the case 3402, and the connecting of the input and output conduits to the input and output ports, respectively. The pre-filter 34 bag mounting ring 3404*a* is constructed to be strong yet flexible. The flexibility allows the pre-filter bag 3404 to be easily removed by the operator for cleaning and replaced after each use.

The first embodiment 10' of this invention uniquely contains the following filtration system components: a thermostatically controlled heating device 3012; an input fluid temperature sensor 3014; an internal system temperature sensor 3016; an alarm device 3002*b*; and a sump structure 32. In this first embodiment, the control circuit 30 is connected to the pump device 20 in order to control the direction of flow initiated by the pump 2002. If an input signal from the control panel 3002*a*, e.g., via membrane switches, commands that the system operate in the processing state, the control circuit 30 will then run the motor 2001 and correspondingly the pump 2002 in a forward (input) vacuum drawing direction. If an input signal from the control panel 3002*a* commands operation in the return state, the control circuit 30 will run the motor 2001 and the pump 2002 in the reverse (output) pumping direction. In addition, the control circuit 30 is connected to the internal cabinet temperature sensor 3016 in order to monitor the temperature of the system when not in use. A thermostatically controlled heater as the application-specific device 3012, is connected to the power source 3004 and physically positioned to heat the entire interior of the electrostatic filter system 10'. The heater maintains the internal system temperature at a constant temperature, 110° F. for example, to prevent residual cooking oil remaining in the system from coagulating or hardening, as discussed earlier. If the control system 30 detects that the heater is not maintaining the desired constant temperature because power is not being provided to both the filter device 10' and heater 3012, or the heater itself has failed, a warning or alarm signal may be generated visually through the control panel 3002*a* and audibly through an alarm device 3002*b*. In this embodiment, the heater 3012 is implemented using a laminated foil sheet element positioned underneath the components it is intended to heat.

Second Embodiment

Figure 8:
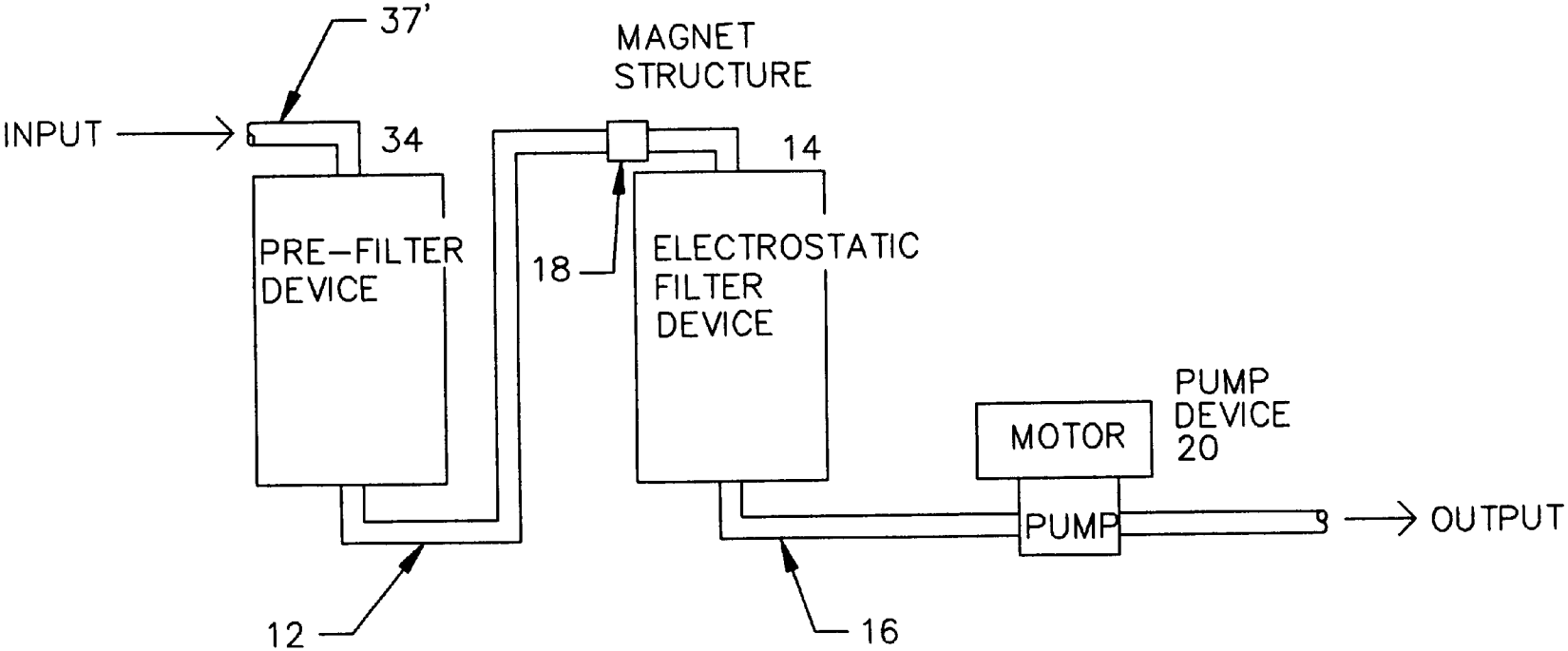
FIG. 8 is a general system diagram of a second preferred embodiment of the present invention.

As shown in FIG. 8, a second embodiment of the present invention is directed to the filtering and processing of hydrocarbon based lubricants such as dielectric Univolt fluid, and other petroleum based fluids such as hydraulic fluid, transmission fluid, and synthetic motor oils. In this embodiment, the fluid filtration system 10" of the present invention incorporates the input conduit 12 connected to the input end of the electrostatic filter device 14, and an output conduit 16 connected at the output end of the electrostatic filter device 14, along with a charcoal filter device 34'.

Variations of the general embodiment of the present invention described above as well as this second embodiment may include the use of an additional pre-filter device similar to 34 of the first embodiment dependent upon the operational condition of the fluid to be filtered. In the general embodiment, such a pre-filter device would be connected to precede the input conduit 12 into the electrostatic filter device 14. In the second embodiment, the additional pre-filter device would be connected to the feed conduit 37' into the charcoal filter device 34'.

A feed conduit 37' is connected to the input of the charcoal filter device 34'. The output of the charcoal filter device 34' is connected to the input conduit 12 into the electrostatic filter device 14. Again as with the general embodiment, the magnet structure 18 is fixedly mounted on the input conduit 12 at or very near the connection point between the input conduit 12 and the electrostatic filter device 14. The output port of the electrostatic filter device 14 is connected to the output conduit 16 which includes the pump device 20.

In this second embodiment, the pump device 20 is configured only to pump dielectric fluid to be processed from the feed conduit 37', into the charcoal filter device 34', through the input conduit 12 into the electrostatic filter device 14, and through the output conduit 16 and return the fluid to the using equipment.

For this second embodiment and application of the present invention, the feed conduit 37', input conduit 12 and output conduit 16 may be formed from cross-linked polyurethane, polyethylene or similar materials. The charcoal filter device 34' may be formed from a conventional charcoal filter structure such as a Norit filter made from synthetic charcoal impregnated polyester.

Third Embodiment

Figure 9:
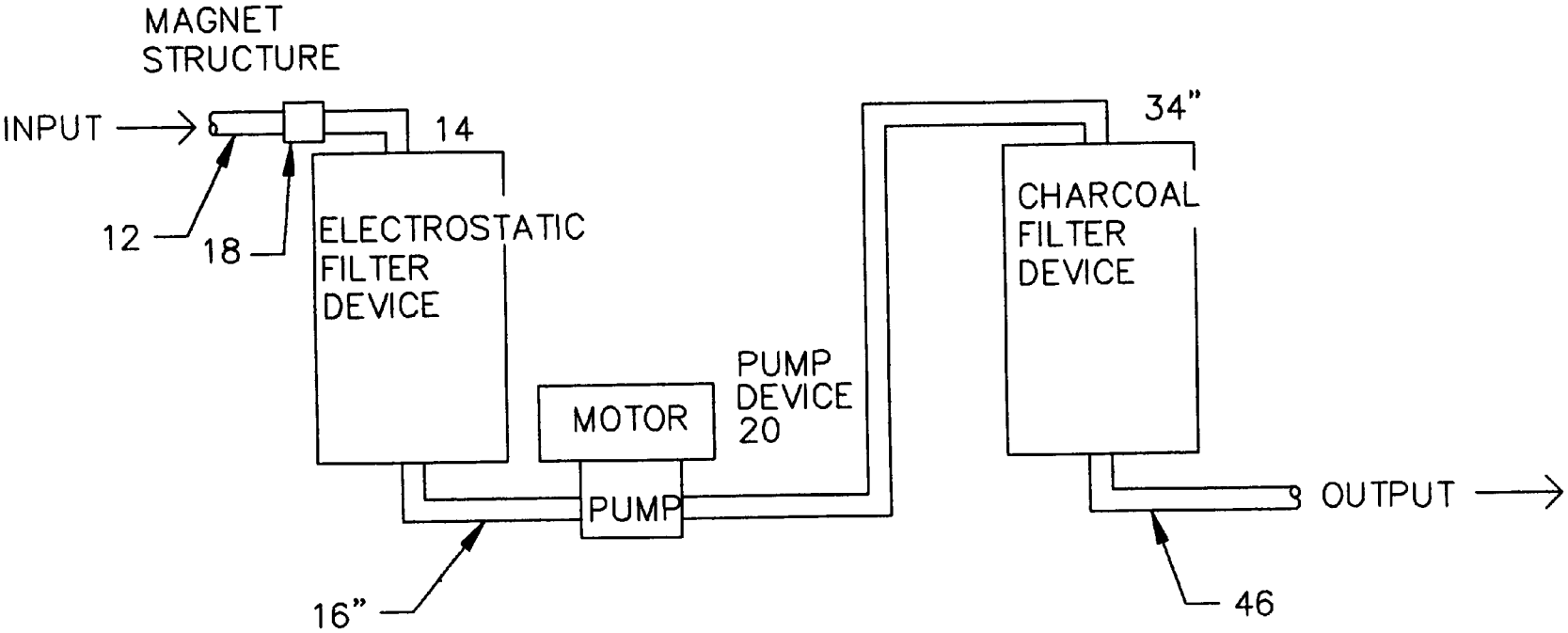
FIG. 9 is a general system diagram of a third preferred embodiment of the present invention.

As shown in FIG. 9, a third embodiment of the present invention is directed to the filtering and processing of solvents such as that used in dry cleaning operations. In this embodiment, the fluid filtration system 10"' of the present invention incorporates the input conduit 12 connected to the input end of the electrostatic filter device 14, and an output conduit 16 connected at the output end of the electrostatic filter device 14, along with a charcoal filter device 34". Again, an additional pre-filter device such as the pre-filter device 34 of the first embodiment may be used and connected to the input conduit 12 depending upon the operational condition of the fluid to be cleaned.

In accordance with the general embodiment of the present invention, the input conduit 12 connects into the electrostatic filter device 14. The magnet structure 18 is fixedly mounted on the input conduit 12 at or very near the connection point between the input conduit 12 and the electrostatic filter device 14. The output port of the electrostatic filter device 14 is connected to the output conduit 16" which includes the pump device 20. Downstream of the pump device 20, the output conduit 16" is connected to the input of the charcoal filter device 34". The output of the charcoal filter device 34" is connected to a recovered output conduit 46 for return to the using equipment.

In this third embodiment, the pump device 20 is also configured only to pump solvent fluid to be processed from the input conduit 12 into the electrostatic filter device 14, through the output conduit 16" into the charcoal filter device 34" and out through the recovered output conduit 46.

For this embodiment and application of the present invention, the input conduit 12, output conduit 16" and recovered output conduit 46 may also be formed from cross-linked polyurethane, polyethylene or similar materials. The charcoal filter device 34" may be formed from a conventional charcoal filter structure such as that used in the second embodiment described above. The additional pre-filter device would be used to eliminate debris greater than 5 microns in diameter from the fluid before entering this embodiments' electrostatic filter.

Fourth Embodiment

Figure 10:
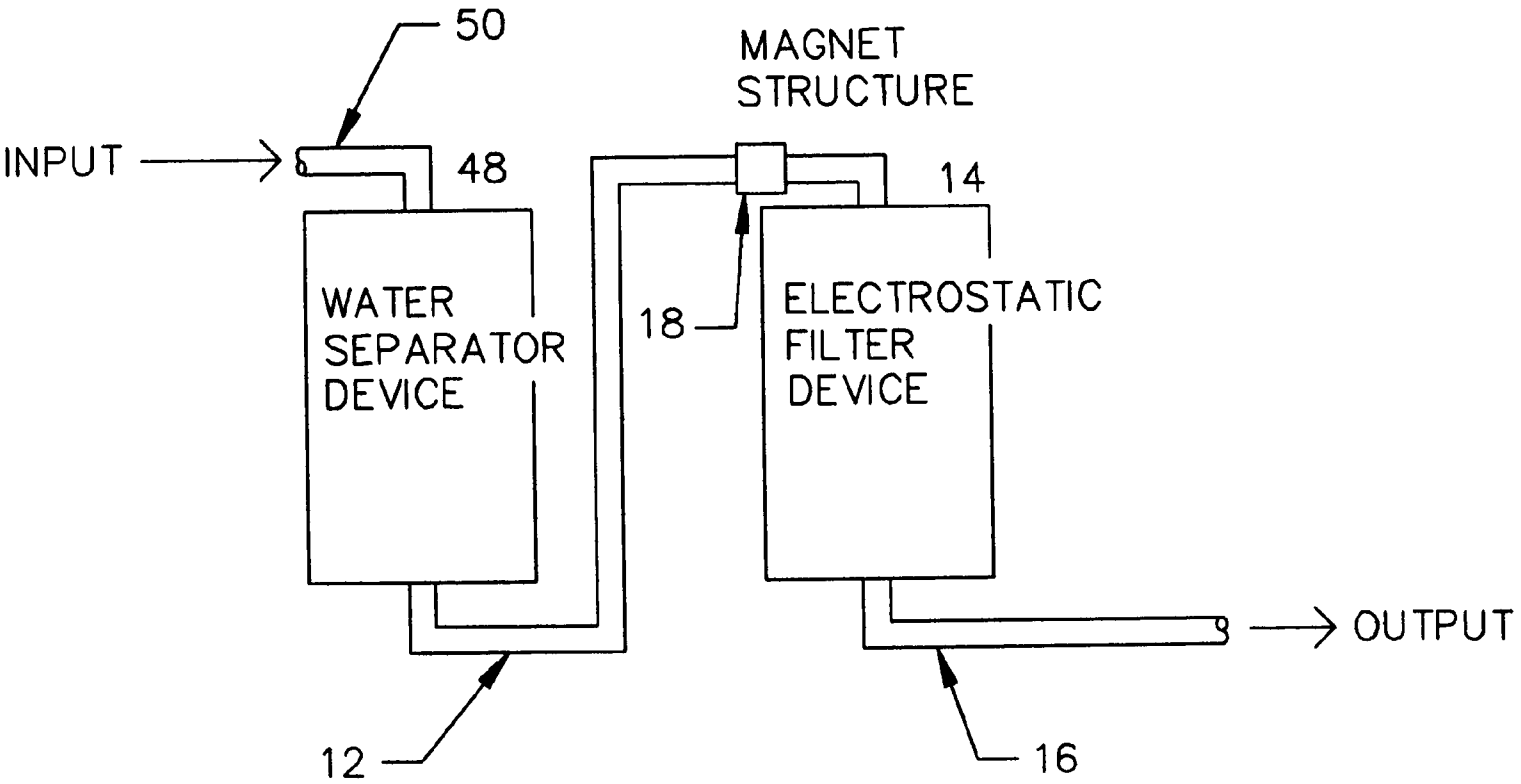
FIG. 10 is a general system diagram of a fourth preferred embodiment of the present invention.

In a further embodiment, the present invention as shown in FIG. 10 is directed to the filtering and processing of diesel and jet engine fuels. In this embodiment, the fluid filtration system 10"" of the present invention incorporates the input conduit 12 connected to the input end of the electrostatic filter device 14, and an output conduit 16 connected at the output end of the electrostatic filter device 14, along with a water separator 48.

A fuel feed conduit 50 is connected to the input of the water separator 48, which may be preceded by a pre-filter device like pre-filter device 34 as in the previous embodiments. The output of the water separator 48 is connected to the input conduit 12 into the electrostatic filter device 14. Once again, as with the general embodiment, the magnet structure 18 is fixedly mounted on the input conduit 12 at or very near the connection point between the input conduit 12 and the electrostatic filter device 14. The output port of the electrostatic filter device 14 is connected to the output conduit 16 which would include a pump device 20' or use the pump integral to the storage tank or motor that holds/burns the cleaned fuel.

In this fourth embodiment, a pump device 20' would be configured only to pump the fuel to be processed from the fuel feed conduit 50, into the water separator 48, through the input conduit 12 into the electrostatic filter device 14, and through the output conduit 16. In at least one implementation of this embodiment, the pump device 20' is embodied in the fuel pump system of a conventional diesel engine that incorporates the present invention.

For this fourth embodiment and application of the present invention, the fuel feed conduit 50, input conduit 12 and output conduit 16 may also be formed from cross-linked polyurethane, polyethylene or similar materials. The water separator 48 may be formed from a conventional water separator structure such as Valcon Model No. VF61EP.

Since the present invention, in at least one implementation, may be incorporated into a diesel engine, the control circuit 30 may be implemented using the engine controller circuit of the diesel engine.

In each of the second through fourth embodiments of the present invention, the structure and operation of the control circuit 30 is consistent with those of the general embodiment of the control circuit 30. However, additional functions, operations and components required to fully implement each of those embodiments may be incorporated into the control circuit 30. Such functions, operations and components consistent with the structure and operation of the control circuit 30 and with the system as a whole would be known and understood by those skilled in the art given this disclosure of the invention.

Although the present invention has been fully described in connection with the preferred embodiment thereof with reference to the accompanying drawings, it is to be noted that various changes and modifications will be apparent to those skilled in the art. For example, the control circuit 30 may be constructed to control the voltage/current levels delivered by the high voltage power supply 3006 to the electrostatic filter device 14. The control circuit 30 may also be configured to control the speed of the motor 2001, and thereby control the speed of the pump 2002. Additional sensors may be connected to the control circuit 30 in order to monitor other conditions in the system, i.e., a voltage sensor for monitoring the level of power delivered to the electrostatic filter device, and thereby refine the controlling of the system. Also, in some applications that involve equipment with large internal fluid tanks, such as 350 gallons of locomotive hydraulic fluid or 400 gallons of dry cleaning solvent, a scaled up reservoir similar to reservoir 36 may be used to allow the using equipment tank to be completely emptied before refilling with electrostatically cleaned fluid. Other different fluids, hazardous materials and fuels may also be processed by the above embodiments or other configurations of the present invention. The size and scope of the present invention is scaleable and determined by the rate of fluid flow demanded by the operating environment (e.g., 5.5 gpm). Increasing the size of the electrostatic filter package 1404 increases the "oil face" and allows high flow rates to be cleaned as well as lower flow rates. These and other such changes and modifications are to be understood as included within the scope of the present invention as defined by the appended claims.

What is claimed is:

1. A system for electrostatic filtering of fluids, comprising:

an electrostatic filtering device for filtering out contaminants from a fluid to be processed, said electrostatic filtering device including a plurality of electrostatic filter packages stacked one on top of the other, each of said filter packages including a filter tray, a filter element and an electrostatic plate, and means for selectively one of electrically charging or grounding each electrostatic plate such that an electrostatic plate of at least one filter package is electrically charged and an electrostatic plate of at least one other filter package is grounded;

an input conduit connected to an input to said electrostatic filter device through which the fluid to be processed is introduced into said electrostatic filter device;

an output conduit connected to an output from said electrostatic filter device through which the fluid to be processed is removed from said electrostatic filter device;

a magnet device fixedly mounted on said input conduit a predetermined distance from said input to said electrostatic filter device for magnetizing contaminant particles in said fluid to be processed, whereby said magnetized contaminant particles are electrostatically charged flowing through said electrostatic filter devices and thereby trapped in said electrostatic filter packages; and means for vacuum drawing said fluid to be processed from said input conduit, into and through said electrostatic filter device, and out through said output conduit, said vacuum drawing means being operatively connected to said output conduit so as to vacuum draw fluid flowing therethrough.

2. A system for electrostatic filtering of fluids according to claim 1, further comprising:

means for controlling operation of said electrostatic filter device and said vacuum drawing means based on a state of at least one of said electrostatic filter device and said fluid to be processed.

3. A system for electrostatic filtering of fluids according to claim 2, wherein said control means includes a plurality of sensors for sensing the state of said electrostatic filter system and said fluid to be processed.

4. A system for electrostatic filtering of fluids according to claim 3, wherein said plurality of sensors include at least one of a first temperature sensor for monitoring a temperature of the fluid to be processed flowing through said input conduit, a second temperature sensor for monitoring an internal temperature of said system, a fluid flow sensor for monitoring a flow of the fluid to be processed through said system, a current flow sensor for monitoring a flow of current through said electrostatic filter device, and a deadman switch for indicating one of a closed position and open position of an enclosure for said system.

5. A system for electrostatic filtering of fluids according to claim 3, wherein said control means includes a programmable controller device for processing data from said plurality of sensors for sensing the state of components of said system and said fluid to be processed.

6. A system for electrostatic filtering of fluids according to claim 2, further comprising:

an external power source for supplying power to said system, said external power source being operatively connected to an input of said control means;

a low voltage power supply for generating low voltage power for said control means; and an adjustable high voltage power supply for generating high voltage power for said electrostatic filter device, wherein said high voltage power supply is operatively connected to an output of said control means, whereby said control means selectively controls transfer of power from said external power source to said high voltage power supply thereby controlling operation of said high voltage power supply.

7. A system for electrostatic filtering of fluids according to claim 6, wherein said electrostatic filtering device includes a filter case in which said plurality of filter packages are mounted and into which the fluid to be processed is inputted for flowing through said plurality of filter packages, a connector element fixedly mounted in said filter case and operatively connected to feed power from said high voltage power supply into said filter case, a first coupling element operatively connected to said connector element to provide an electrical charge to a first set of selected filter packages, and a second coupling element operatively connected to said connector element to ground a second set of selected filter packages.

8. A system for electrostatic filtering of fluids according to claim 7, wherein each of said plurality of electrostatic filter packages further includes said filter tray having a cavity defined therein, a support frame fixedly mounted in said cavity, said electrostatic plate being porous, and said filter element includes a filter sheet fixedly held in position between said support frame and said electrostatic plate, said means for selectively one of electrically charging and grounding said porous electrostatic plate includes a power transfer element formed in said electrostatic plate in each of said plurality of filter packages, first and second apertures defined on opposite sides of said filter tray in each of said plurality of filter packages with said power transfer element being aligned with said first aperture, said first and second apertures further being located in said filter tray so as to align with said first and second coupling elements, and each of said plurality of filter packages being positioned in said filter case so as to selectively align said first aperture and thereby connect said power transfer element with one of said first and second coupling elements and align said second aperture to thereby connect said power transfer element with the other of said first and second coupling elements, whereby each of said plurality of filter packages is selectively electrically charged or grounded.

9. A system for electrostatic filtering of fluids according to claim 2, wherein said control means includes a programmable controller device.

10. A system for electrostatic filtering of fluids according to claim 2, wherein said means for vacuum drawing said fluid to be processed includes a pump, and a motor operatively connected to move said pump, said motor being further operatively connected to said control means such that said control means selectively controls operation of said motor and said pump.

11. A system for electrostatic filtering of fluids according to claim 1, wherein said means for vacuum drawing said fluid to be processed includes a pump, and a motor operatively connected to move said pump.

12. A system for electrostatic filtering of fluids according to claim 1, wherein said electrostatic filtering device includes a filter case in which said plurality of filter packages are mounted and into which the fluid to be processed is inputted for flowing through said plurality of filter packages, a connector element fixedly mounted in said filter case and operatively connected to feed power into said filter case, a first coupling element operatively connected to said connector element to provide an electrical charge to a first set of selected filter packages, and a second coupling element operatively connected to said connector element to ground a second set of selected filter packages.

13. A system for electrostatic filtering of fluids according to claim 1, wherein said electrostatic filter device further includes a first power rod adapted to be connected to a source of electricity and a second power rod adapted to be connected to an electrical ground and each of said plurality of electrostatic filter packages further includes said filter tray having a cavity defined therein, a support frame fixedly mounted in said cavity, said electrostatic plate being porous and having means for being selectively one of connected with said first power rod or said second power rod thereby being electrically charged or grounded, respectively, and said filter element being a filter sheet fixedly held in position between said support frame and said electrostatic plate.

14. A system for electrostatic filtering of fluids according to claim 1, further comprising:

a mechanical pre-filter device having means for physically filtering contaminants of a predetermined size or greater from the fluid to be processed prior to being processed in said electrostatic filter device, said mechanical pre-filter device being operatively connected to said input conduit to said electrostatic filtering device.

15. A filter element for use in an electrostatic filtration system, comprising:

a filter tray having a cavity defined therein;

a support frame fixedly mounted in said cavity;

a porous electrostatic plate having means for selectively one of electrically charging and grounding said electrostatic plate; and a filter sheet fixedly held in position between said support frame and said electrostatic plate, wherein said support frame is formed so as to support said electrostatic plate relative to said filter sheet so as to define a space between said filter sheet and an electrostatic plate of an adjacent filter element for accommodating accumulation of trapped particulates therebetween.

16. A filter element according to claim 15, wherein said means for selectively one of electrically charging and grounding said porous electrostatic plate includes a power transfer element formed in said electrostatic plate, first and second apertures defined on opposite sides of said filter tray with said power transfer element being aligned with said first aperture, said first aperture being formed and said power transfer element being positioned therewith so as to accommodate a coupling element insertably positioned in said first aperture and operatively contacting with said power transfer element, said coupling element being connected to one of an electrical power source and an electrical ground so as to one of electrically charge or ground said electrostatic plate.

17. An electrostatic filtration system for processing cooking oil, comprising:

a sieve and sump structure for receiving cooking oil to be processed, said sieve and sump structure having means for performing a first stage mechanical filtering of contaminants in the cooking oil to be processed;

a pre-filter device for performing a second stage mechanical filtering of the contaminants in the cooking oil to be processed, said pre-filter device being operatively connected to receive the cooking oil to be processed from said sieve and sump structure;

an electrostatic filtering device for performing a third stage filtering of the contaminants from the cooking oil to be processed, said electrostatic filtering device including a plurality of electrostatic filter packages stacked one on top of the other, each of said filter packages including a filter tray, a filter element and an electrostatic plate, and means for selectively one of electrically charging or grounding each electrostatic plate such that an electrostatic plate of at least one filter package is electrically charged and an electrostatic plate of at least one other filter package is grounded;

a reservoir into which the cooking oil processed through said electrostatic filtering device is temporarily stored;

an input conduit connected between an output of said pre-filter device and an input to said electrostatic filter device through which the cooking oil to be processed is introduced into said electrostatic filter device;

an output conduit connected between an output of said electrostatic filter device and said reservoir;

a magnet device fixedly mounted on said input conduit a predetermined distance from said input to said electrostatic filter device for magnetizing contaminant particles in the cooking oil to be processed, whereby said magnetized contaminant particles are electrostatically charged flowing through said electrostatic filter devices and thereby trapped in said electrostatic filter packages; and means for vacuum drawing said cooking oil to be processed at least from said input conduit, into and through said pre-filter device and said electrostatic filter device, and out through said output conduit to said reservoir, said vacuum drawing means being operatively connected to said output conduit so as to vacuum draw the cooking oil flowing therethrough.

18. An electrostatic filtration system for processing cooking oil according to claim 17, further comprising:

means for controlling operation of said electrostatic filter device and said vacuum drawing means based on a state of at least one of said electrostatic filter device and said cooking oil to be processed.

19. An electrostatic filtration system for processing cooking oil according to claim 18, wherein said control means includes a plurality of sensors for sensing the state of said system and said cooking oil to be processed.

20. An electrostatic filtration system for processing cooking oil according to claim 19, wherein said plurality of sensors include at least one of a first temperature sensor for monitoring a temperature of the cooking oil to be processed flowing through said input conduit, a second temperature sensor for monitoring an internal temperature of said system, a fluid flow sensor for monitoring a flow of the cooking oil to be processed through said system, a current flow sensor for monitoring a flow of current through said electrostatic filter device, and a deadman switch for indicating one of a closed position and open position of an enclosure for said system.

21. An electrostatic filtration system for processing cooking oil according to claim 19, wherein said control means includes a programmable controller device for processing data from said plurality of sensors for sensing the state of said system and said cooking oil to be processed.

22. An electrostatic filtration system for processing cooking oil according to claim 18, further comprising:

an external power source for supplying power to said system, said external power source being operatively connected to an input of said control means;

a low voltage power supply for generating low voltage power for said control means; and an adjustable high voltage power supply for generating high voltage power for said electrostatic filter device, wherein said high voltage power supply is operatively connected to an output of said control means, whereby said control means selectively controls transfer of power from said external power source to said adjustable high voltage power supply thereby controlling operation of said high voltage power supply.

23. An electrostatic filtration system for processing cooking oil according to claim 22, wherein said electrostatic filtering device includes a filter case in which said plurality of filter packages are mounted and into which the cooking oil to be processed is inputted for flowing through said plurality of filter packages, a connector element fixedly mounted in said filter case and operatively connected to feed power from said high voltage power supply into said filter case, a first coupling element operatively connected to said connector element to provide an electrical charge to a first set of selected filter packages, and a second coupling element operatively connected to said connector element to ground a second set of selected filter packages, and said input conduit being operatively connected to a top portion of said filter case and said output being operatively connected to a bottom portion of said filter case, whereby cooking oil to be processed flows into said filter case at said top portion, through said plurality of electrostatic filter packages and out at said bottom portion.

24. An electrostatic filtration system for processing cooking oil according to claim 23, wherein each of said plurality of electrostatic filter packages further includes said filter tray having a cavity defined therein, a support frame fixedly mounted in said cavity, said electrostatic plate being porous, and said filter element includes a filter sheet fixedly held in position between said support frame and said electrostatic plate, said means for selectively one of electrically charging and grounding said electrostatic plate includes a power transfer element formed in said electrostatic plate in each of said plurality of filter packages, first and second apertures defined on opposite sides of said filter tray in each of said plurality of filter packages with said power transfer element being aligned with said first aperture, said first and second apertures further being located in said filter tray so as to align with said first and second coupling elements, and each of said plurality of filter packages being positioned in said filter case so as to selectively align said first aperture and thereby connect said power transfer element with one of said first and second coupling elements, whereby each of said plurality of filter packages is selectively electrically charged or grounded, respectively.

25. An electrostatic filtration system for processing cooking oil according to claim 18, wherein said control means includes a programmable controller device.

26. An electrostatic filtration system for processing cooking oil according to claim 18, wherein said means for vacuum drawing said cooking oil to be processed includes a pump, said pump being operatively connected between said output conduit and said reservoir, and a motor operatively connected to move said pump, said motor being further operatively connected to said control means such that said control means selectively controls operation of said motor and said pump.

27. An electrostatic filtration system for processing cooking oil according to claim 26, wherein said means for vacuum drawing said cooking oil to be processed includes a bi-directional pump operatively connected between said output conduit and said reservoir, and a bi-directional motor operatively connected to move said pump, said motor being further operatively connected to said control means such that said control means selectively controls forward and reverse flow operation of said motor and said pump, said system further comprising:

a bifurcated joint member operatively connected along said output conduit via a bi-directional port thereof to said vacuum drawing means and at an input port thereof to said electrostatic filter device;

a return flow conduit through which processed cooking oil is outputted from said reservoir, said return flow conduit being connected to an output port of said bifurcated joint member;

a bi-directional conduit operatively connected between said bi-directional pump and said reservoir;

a first check valve operatively connected between said output conduit and said input port of said bifurcated joint member and positioned so as to prevent flow of cooking oil from said bifurcated joint to said electrostatic filter device when processed cooking oil is being outputted from said reservoir; and a second check valve operatively connected between said return flow conduit and said output port of said bifurcated joint member and positioned so as to prevent flow of cooking oil from said bifurcated joint to said return flow conduit when processed cooking oil is directed toward said reservoir.

28. An electrostatic filtration system for processing cooking oil according to claim 26, said vacuum drawing means further includes a relief valve connected between said output conduit and said pump, said relief valve being formed to cut off fluid flow through said pump when cooking oil fluid flow drops below a predetermined level.

29. An electrostatic filtration system for processing cooking oil according to claim 18, wherein said electrostatic filtering device includes a filter case in which said plurality of filter packages are mounted and into which the cooking oil to be processed is inputted for flowing through said plurality of filter packages, a connector element fixedly mounted in said filter case and operatively connected to feed power into said filter case, a first coupling element operatively connected to said connector element to provide an electrical charge to a first set of selected filter packages, and a second coupling element operatively connected to said connector element to ground a second set of selected filter packages.

30. An electrostatic filtration system for processing cooking oil according to claim 18, wherein said electrostatic filter device further includes a first power rod adapted to be connected to a source of electricity and a second power rod adapted to be connected to an electrical ground, and each of said plurality of electrostatic filter packages further includes said filter tray having a cavity defined therein, a support frame fixedly mounted in said cavity, said electrostatic plate being porous and having means for being selectively one of connected with said first power rod or said second power rod thereby being electrically charged or grounded, respectively, and said filter element being a filter sheet fixedly held in position between said support frame and said electrostatic plate.

31. An electrostatic filtration system for processing cooking oil according to claim 17, wherein said means for vacuum drawing said cooking oil to be processed includes a pump, and a motor operatively connected to move said pump.

32. An electrostatic filtration system for processing cooking oil according to claim 17, wherein said sieve and sump structure includes a strainer pan having a bottom with a plurality of perforations defined thereon for straining the cooking oil to be processed said bottom panel being fixedly formed to decline at a predetermined angle relative to a horizontal plane so as to promote downward flow of said cooking oil by gravity, and a reservoir pan operatively positioned underneath said strainer pan for receiving cooking oil strained by said strainer pan, said reservoir pan having a floor panel formed in a substantially cone-like shape to promote downward flow by gravity.

33. An electrostatic filtration system for processing cooking oil according to claim 17, wherein said pre-filter device includes a pre-filter case in which a pre-filter bag is mounted, said feed conduit being operatively connected to a top portion of said pre-filter case and said input conduit being operatively connected to a bottom portion of said pre-filter case, whereby cooking oil to be processed flows into said pre-filter case at said top portion, through said pre-filter bag and out at said bottom portion.

34. An electrostatic filtration system for processing cooking oil according to claim 17, wherein said pre-filter device includes means for physically filtering contaminants of a predetermined size or greater from said cooking oil to be processed.

35. An electrostatic filtration system for processing cooking oil according to claim 17, wherein said vacuum drawing means further includes means for vacuum drawing said electrostatically cleaned cooking oil from said reservoir, and out through said output conduit and back to an originating cooking oil fryer.

36. An electrostatic filtration system for processing dielectric fluid, comprising:

a pre-filter device for performing a first stage filtering of contaminants in dielectric fluid to be processed, said pre-filter device being operatively connected to receive the dielectric fluid to be processed;

an electrostatic filtering device for performing a second stage filtering of the contaminants from the dielectric fluid to be processed, said electrostatic filtering device including a plurality of electrostatic filter packages stacked one on top of the other, each of said filter packages including a filter tray, a filter element and an electrostatic plate, and means for selectively one of electrically charging or grounding each electrostatic plate such that an electrostatic plate of at least one filter package is electrically charged and an electrostatic plate of at least one other filter package is grounded;

an input conduit connected between an output of said pre-filter device and an input to said electrostatic filter device through which the dielectric fluid to be processed is introduced into said electrostatic filter device;

an output conduit connected to an output of said electrostatic filter device;

a magnet device fixedly mounted on said input conduit a predetermined distance from said input to said electrostatic filter device for magnetizing contaminant particles in the dielectric fluid to be processed, whereby said magnetized contaminant particles are electrostatically charged flowing through said electrostatic filter devices and thereby trapped in said electrostatic filter packages;

means for vacuum drawing said fluid to be processed at least from said input conduit, into and through said pre-filter device and said electrostatic filter device, and out through said output conduit, said vacuum drawing being operatively connected to said output conduit so as to vacuum draw the dielectric fluid flowing therethrough.

37. An electrostatic filtration system for processing dielectric fluid according to claim 36, further comprising:

means for controlling operation of said electrostatic filter device and said vacuum drawing means based on a state of at least one of said electrostatic filter device and said dielectric fluid to be processed.

38. An electrostatic filtration system for processing dielectric fluid according to claim 37, wherein said control means includes a plurality of sensors for sensing the state of said electrostatic filter system and said dielectric fluid to be processed.

39. An electrostatic filtration system for processing dielectric fluid according to claim 38, wherein said plurality of sensors include at least one of a fluid flow sensor for monitoring a flow of the dielectric fluid to be processed through said system, a current flow sensor for monitoring a flow of current through said electrostatic filter device and a deadman switch for indicating one of a closed position and open position of an enclosure for said system.

40. An electrostatic filtration system for processing dielectric fluid according to claim 38, wherein said control means includes a programmable controller device for processing data from said plurality of sensors for sensing the state of said system and said dielectric fluid to be processed.

41. An electrostatic filtration system for processing dielectric fluid according to claim 37, further comprising:

an external power source for supplying power to said system, said external power source being operatively connected to an input of said control means;

a low voltage power supply for generating low voltage power for said control means; and an adjustable high voltage power supply for generating high voltage power for said electrostatic filter device, wherein said high voltage power supply is operatively connected to an output of said control means, whereby said control means selectively controls transfer of power from said external power source to said high voltage power supply thereby controlling operation of said high voltage power supply.

42. An electrostatic filtration system for processing dielectric fluid according to claim 41, wherein said electrostatic filtering device includes a filter case in which said plurality of filter packages are mounted and into which the dielectric fluid to be processed is inputted for flowing through said plurality of filter packages, a connector element fixedly mounted in said filter case and operatively connected to feed power from said high voltage power supply into said filter case, a first coupling element operatively connected to said connector element to provide an electrical charge to a first set of selected filter packages, and a second coupling element operatively connected to said connector element to ground a second set of selected filter packages, and said input conduit being operatively connected to a top portion of said filter case and said output being operatively connected to a bottom portion of said filter case, whereby dielectric fluid to be processed flows into said filter case at said top portion, through said plurality of electrostatic filter packages and out at said bottom portion.

43. An electrostatic filtration system for processing dielectric fluid according to claim 42, wherein each of said plurality of electrostatic filter packages further includes said filter tray having a cavity defined therein, a support frame fixedly mounted in said cavity, said electrostatic plate being porous, and said filter element includes a filter sheet fixedly held in position between said support frame and said electrostatic plate, said means for selectively one of electrically charging and grounding said electrostatic plate includes a power transfer element formed in said electrostatic plate in each of said plurality of filter packages, first and second apertures defined on opposite sides of said filter tray in each of said plurality of filter packages with said power transfer element being aligned with said first aperture, said first and second apertures further being located in said filter tray so as to align with said first and second coupling elements, and each of said plurality of filter packages being positioned in said filter case so as to selectively align said first aperture and thereby connect said power transfer element with one of said first and second coupling elements, whereby each of said plurality of filter packages is selectively electrically charged or grounded, respectively.

44. An electrostatic filtration system for processing dielectric fluid according to claim 37, wherein said control means includes a programmable controller device.

45. An electrostatic filtration system for processing dielectric fluid according to claim 37, wherein said means for vacuum drawing said dielectric fluid to be processed includes a pump, said pump being operatively connected along said output conduit, and a motor operatively connected to move said pump, said motor being further operatively connected to said control means such that said control means selectively controls operation of said motor and said pump.

46. An electrostatic filtration system for processing dielectric fluid according to claim 37, wherein said electrostatic filtering device includes a filter case in which said plurality of filter packages are mounted and into which the fluid to be processed is inputted for flowing through said plurality of filter packages, a connector element fixedly mounted in said filter case and operatively connected to feed power into said filter case, a first coupling element operatively connected to said connector element to provide an electrical charge to a first set of selected filter packages, and a second coupling element operatively connected to said connector element to ground a second set of selected filter packages.

47. An electrostatic filtration system for processing dielectric fluid according to claim 37, wherein said electrostatic filter device further includes a first power rod adapted to be connected to a source of electricity and a second power rod adapted to be connected to an electrical ground, and each of said plurality of electrostatic filter packages further includes said filter tray having a cavity defined therein, a support frame fixedly mounted in said cavity, said electrostatic plate being porous and having means for being selectively one of connected with said first power rod or said second power rod thereby being electrically charged or grounded, respectively, and said filter element being a filter sheet fixedly held in position between said support frame and said electrostatic plate.

48. An electrostatic filtration system for processing dielectric fluid according to claim 36, wherein said means for vacuum drawing said dielectric fluid to be processed includes a pump, and a motor operatively connected to move said pump.

49. An electrostatic filtration system for processing dielectric fluid according to claim 36, wherein said pre-filter device includes a charcoal filter device.

50. An electrostatic filtration system for processing dielectric fluid according to claim 36, further comprising:

a supplemental mechanical pre-filter device having means for physically filtering contaminants of a predetermined size or greater from the dielectric fluid to be processed prior to being processed in said pre-filter device, said supplemental mechanical pre-filter device being operatively connected to an input of said pre-filter device.

51. An electrostatic filtration system for processing dry cleaning solvent, comprising:

an electrostatic filtering device for performing a first stage filtering of contaminants from dry cleaning solvent to be processed, said electrostatic filtering device including a plurality of electrostatic filter packages stacked one on top of the other, each of said filter packages including a filter tray, a filter element and an electrostatic plate, and means for selectively one of electrically charging or grounding each electrostatic plate such that an electrostatic plate of at least one filter package is electrically charged and an electrostatic plate of at least one other filter package is grounded;

an input conduit connected to an input to said electrostatic filter device through which the dry cleaning solvent to be processed is introduced into said electrostatic filter device;

an output conduit connected to an output of said electrostatic filter device;

a secondary filter device for performing a second stage filtering of the contaminants in the dry cleaning solvent to be processed, said secondary filter device being operatively connected to said output conduit so as to receive the dry cleaning solvent to be processed from said electrostatic filter device;

a magnet device fixedly mounted on said input conduit a predetermined distance from said input to said electrostatic filter device for magnetizing contaminant particles in the dry cleaning solvent to be processed, whereby said magnetized contaminant particles are electrostatically charged flowing through said electrostatic filter devices and thereby trapped in said electrostatic filter packages;

means for vacuum drawing said fluid to be processed at least from said input conduit, into and through said electrostatic filter device, out through said output conduit to said secondary filter device, said vacuum drawing being operatively connected to said output conduit so as to vacuum draw the dry cleaning solvent flowing therethrough.

52. An electrostatic filtration system for processing dry cleaning solvent according to claim 51, further comprising:

means for controlling operation of said electrostatic filter device and said vacuum drawing means based on a state of at least one of said electrostatic filter device and said dry cleaning solvent to be processed.

53. An electrostatic filtration system for processing dry cleaning solvent according to claim 52, wherein said control means includes a plurality of sensors for sensing the state of said system and said dry cleaning solvent to be processed.

54. An electrostatic filtration system for processing dry cleaning solvent according to claim 53, wherein said plurality of sensors include at least one of a fluid flow sensor for monitoring a flow of the dry cleaning solvent to be processed through said system, a current flow sensor for monitoring a flow of current through said electrostatic filter device and a deadman switch for indicating one of a closed position and open position of an enclosure for said system.

55. An electrostatic filtration system for processing dry cleaning solvent according to claim 53, wherein said control means includes a programmable controller device for processing data from said plurality of sensors for sensing the state of said system and said dry cleaning solvent to be processed.

56. An electrostatic filtration system for processing dry cleaning solvent according to claim 52, further comprising:

an external power source for supplying power to said system, said external power source being operatively connected to an input of said control means;

a low voltage power supply for generating low voltage power for said control means; and an adjustable high voltage power supply for generating high voltage power for said electrostatic filter device, wherein said high voltage power supply is operatively connected to an output of said control means, whereby said control means selectively controls transfer of power from said external power source to said high voltage power supply thereby controlling operation of said high voltage power supply.

57. An electrostatic filtration system for processing dry cleaning solvent according to claim 56, wherein said electrostatic filtering device includes a filter case in which said plurality of filter packages are mounted and into which the dry cleaning solvent to be processed is inputted for flowing through said plurality of filter packages, a connector element fixedly mounted in said filter case and operatively connected to feed power from said high voltage power supply into said filter case, a first coupling element operatively connected to said connector element to provide an electrical charge to a first set of selected filter packages, and a second coupling element operatively connected to said connector element to ground a second set of selected filter packages, and said input conduit being operatively connected to a top portion of said filter case and said output being operatively connected to a bottom portion of said filter case, whereby dry cleaning solvent to be processed flows into said filter case at said top portion, through said plurality of electrostatic filter packages and out at said bottom portion.

58. An electrostatic filtration system for processing dry cleaning solvent according to claim 57, wherein each of said plurality of electrostatic filter packages further includes said filter tray having a cavity defined therein, a support frame fixedly mounted in said cavity, said electrostatic plate, being porous, and said filter element includes a filter sheet fixedly held in position between said support frame and said electrostatic plate, said means for selectively one of electrically charging and grounding said electrostatic plate includes a power transfer element formed in said electrostatic plate in each of said plurality of filter packages, first and second apertures defined on opposite sides of said filter tray in each of said plurality of filter packages with said power transfer element being aligned with said first aperture, said first and second apertures further being located in said filter tray so as to align with said first and second coupling elements, and each of said plurality of filter packages being positioned in said filter case so as to selectively align said first aperture and thereby connect said power transfer element with one of said first and second coupling elements, whereby each of said plurality of filter packages is selectively electrically charged or grounded, respectively.

59. An electrostatic filtration system for processing dry cleaning solvent according to claim 52, wherein said control means includes a programmable controller device.

60. An electrostatic filtration system for processing dry cleaning solvent according to claim 52, wherein said means for vacuum drawing said dry cleaning solvent to be processed includes a pump, said pump being operatively connected along said output conduit between said electrostatic filter device and said secondary filter device, and a motor operatively connected to move said pump, said motor being further operatively connected to said control means such that said control means selectively controls operation of said motor and said pump.

61. An electrostatic filtration system for processing dry cleaning solvent according to claim 52, wherein said electrostatic filtering device includes a filter case in which said plurality of filter packages are mounted and into which the fluid to be processed is inputted for flowing through said plurality of filter packages, a connector element fixedly mounted in said filter case and operatively connected to feed power into said filter case, a first coupling element operatively connected to said connector element to provide an electrical charge to a first set of selected filter packages, and a second coupling element operatively connected to said connector element to ground a second set of selected filter packages.

62. An electrostatic filtration system for processing dry cleaning solvent according to claim 52, wherein said electrostatic filter device further includes a first power rod adapted to be connected to a source of electricity and a second power rod adapted to be connected to an electrical ground and each of said plurality of electrostatic filter packages further includes said filter tray having a cavity defined therein, a support frame fixedly mounted in said cavity, said electrostatic plate being porous and having means for being selectively one of connected with said first power rod or said second power rod thereby being electrically charged or grounded, respectively, and said filter element being a filter sheet fixedly held in position between said support frame and said electrostatic plate.

63. An electrostatic filtration system for processing dry cleaning solvent according to claim 56, wherein said means for vacuum drawing said dry cleaning solvent to be processed includes a pump, and a motor operatively connected to move said pump.

64. An electrostatic filtration system for processing dry cleaning solvent according to claim 51, wherein said secondary filter device includes a charcoal filter device.

65. An electrostatic filtration system for processing dry cleaning solvent according to claim 51, further comprising:

a mechanical pre-filter device having means for physically filtering contaminants of a predetermined size or greater from the dry cleaning solvent to be processed prior to being processed in said electrostatic filtering device, said mechanical pre-filter device being operatively connected to said input conduit to said electrostatic filtering device.

66. An electrostatic filtration system for processing diesel fuel, comprising:

a water separator device for performing water separation in the diesel fuel to be processed, said water separator device being operatively connected to receive the diesel fuel to be processed;

an electrostatic filtering device for filtering contaminants from the diesel fuel to be processed, said electrostatic filtering device including a plurality of electrostatic filter packages stacked one on top of the other, each of said filter packages including a filter tray, a filter element and an electrostatic plate, and means for selectively one of electrically charging or grounding each electrostatic plate such that an electrostatic plate of at least one filter package is electrically charged and an electrostatic plate of at least one other filter package is grounded;

an input conduit connected between an output of said water separator device and an input to said electrostatic filter device through which the diesel fuel to be processed is introduced into said electrostatic filter device;

an output conduit connected to an output of said electrostatic filter device;

a magnet device fixedly mounted on said input conduit a predetermined distance from said input to said electrostatic filter device for magnetizing contaminant particles in the diesel fuel to be processed, whereby said magnetized contaminant particles are electrostatically charged flowing through said electrostatic filter devices and thereby trapped in said electrostatic filter packages;

means for vacuum drawing said fluid to be processed at least from said input conduit, into and through said water separator device and said electrostatic filter device, and out through said output conduit, said vacuum drawing being operatively connected to said output conduit so as to vacuum draw the diesel fuel flowing therethrough.

67. An electrostatic filtration system for processing diesel fuel according to claim 66, further comprising:

means for controlling operation of said electrostatic filter device and said vacuum drawing means based on a state of at least one of said electrostatic filter device and said diesel fuel to be processed.

68. An electrostatic filtration system for processing diesel fuel according to claim 62, wherein said control means includes a plurality of sensors for sensing the state of said electrostatic filter device and said diesel fuel to be processed.

69. An electrostatic filtration system for processing diesel fuel according to claim 68, wherein said plurality of sensors include at least one of a fluid flow sensor for monitoring a flow of the diesel fuel to be processed through said system, a current flow sensor for monitoring a flow of current through said electrostatic filter device and a deadman switch for indicating one of a closed position and open position of an enclosure for said system.

70. An electrostatic filtration system for processing diesel fuel according to claim 68, wherein said control means includes a programmable controller device for processing data from said plurality of sensors for sensing the state of said system and said diesel fuel to be processed.

71. An electrostatic filtration system for processing diesel fuel according to claim 67, further comprising:

an external power source for supplying power to said system, said external power source being operatively connected to an input of said control means;

a low voltage power supply for generating low voltage power for said control means; and an adjustable high voltage power supply for generating high voltage power for said electrostatic filter device, wherein said high voltage power supply is operatively connected to an output of said control means, whereby said control means selectively controls transfer of power from said external power source to said high voltage power supply thereby controlling operation of said high voltage power supply.

72. An electrostatic filtration system for processing diesel fuel according to claim 71, wherein said electrostatic filtering device includes a filter case in which said plurality of filter packages are mounted and into which the diesel fuel to be processed is inputted for flowing through said plurality of filter packages, a connector element fixedly mounted in said filter case and operatively connected to feed power from said high voltage power supply into said filter case, a first coupling element operatively connected to said connector element to provide an electrical charge to a first set of selected filter packages, and a second coupling element operatively connected to said connector element to ground a second set of selected filter packages, and said input conduit being operatively connected to a top portion of said filter case and said output being operatively connected to a bottom portion of said filter case, whereby diesel fuel to be processed flows into said filter case at said top portion, through said plurality of electrostatic filter packages and out at said bottom portion.

73. An electrostatic filtration system for processing diesel fuel according to claim 72, wherein each of said plurality of electrostatic filter packages further includes said filter tray having a cavity defined therein, a support frame fixedly mounted in said cavity, said electrostatic plate being porous, and said filter element includes a filter sheet fixedly held in position between said support frame and said electrostatic plate, said means for selectively one of electrically charging and grounding said electrostatic plate includes a power transfer element formed in said electrostatic plate in each of said plurality of filter packages, first and second apertures defined on opposite sides of said filter tray in each of said plurality of filter packages with said power transfer element being aligned with said first aperture, said first and second apertures further being located in said filter tray so as to align with said first and second coupling elements, and each of said plurality of filter packages being positioned in said filter case so as to selectively align said first aperture and thereby connect said power transfer element with one of said first and second coupling elements, whereby each of said plurality of filter packages is selectively electrically charged or grounded, respectively.

74. An electrostatic filtration system for processing diesel fuel according to claim 67, wherein said control means includes a programmable controller device.

75. An electrostatic filtration system for processing diesel fuel according to claim 67, wherein said control means includes an electronic engine controller for a diesel engine.

76. An electrostatic filtration system for processing diesel fuel according to claim 67, wherein said electrostatic filtering device includes a filter case in which said plurality of filter packages are mounted and into which the fluid to be processed is inputted for flowing through said plurality of filter packages, a connector element fixedly mounted in said filter case and operatively connected to feed power into said filter case, a first coupling element operatively connected to said connector element to provide an electrical charge to a first set of selected filter packages, and a second coupling element operatively connected to said connector element to ground a second set of selected filter packages.

77. An electrostatic filtration system for processing diesel fuel according to claim 67, wherein said electrostatic filter device further includes a first power rod adapted to be connected to a source of electricity and a second power rod adapted to be connected to an electrical ground, and each of said plurality of electrostatic filter packages further includes said filter tray having a cavity defined therein, a support frame fixedly mounted in said cavity, said electrostatic plate being porous and having means for being selectively one of connected with said first power rod or said second power rod thereby being electrically charged or grounded, respectively, and said filter element being a filter sheet fixedly held in position between said support frame and said electrostatic plate.

78. An electrostatic filtration system for processing diesel fuel according to claim 66, wherein said means for vacuum drawing said diesel fuel to be processed includes a fuel pump for a diesel engine.

79. An electrostatic filtration system for processing diesel fuel according to claim 66, further comprising:

a mechanical pre-filter device having means for physically filtering contaminants of a predetermined size or greater from the diesel fuel to be processed prior to being processed in said water separator device, said mechanical pre-filter device being operatively connected to an input of said water separator device.

* * * * *